US008952232B2

(12) United States Patent
Parsons et al.

(10) Patent No.: US 8,952,232 B2
(45) Date of Patent: Feb. 10, 2015

(54) CIRCULAR PIANO KEYBOARD

(71) Applicants: Brockett Parsons, West Hollywood, CA (US); Charles E. Johnson, Atkinson, NH (US); Kareem Devlin Byrne, Brooklyn, NY (US); Richard Fell, Woburn, MA (US); James M. Behmke, East Walpole, MA (US)

(72) Inventors: Brockett Parsons, West Hollywood, CA (US); Charles E. Johnson, Atkinson, NH (US); Kareem Devlin Byrne, Brooklyn, NY (US); Richard Fell, Woburn, MA (US); James M. Behmke, East Walpole, MA (US)

(73) Assignee: PianoArc, LLC, Ipswich, MA (US)

( * ) Notice: Subject to any disclaimer, the term of this patent is extended or adjusted under 35 U.S.C. 154(b) by 0 days.

(21) Appl. No.: 13/740,962

(22) Filed: Jan. 14, 2013

(65) Prior Publication Data

US 2013/0192444 A1 Aug. 1, 2013

Related U.S. Application Data

(60) Provisional application No. 61/586,111, filed on Jan. 12, 2012.

(51) Int. Cl.
*G10C 3/12* (2006.01)
*G10H 1/34* (2006.01)

(52) U.S. Cl.
CPC ..... *G10C 3/12* (2013.01); *G10H 1/344* (2013.01); *G10H 2220/221* (2013.01)
USPC ..... 84/429; 84/423 R

(58) Field of Classification Search
USPC ..... 84/429, 423 R
See application file for complete search history.

(56) References Cited

U.S. PATENT DOCUMENTS

| | | | | | |
|---|---|---|---|---|---|
| 2,081 | A | * | 5/1841 | Dwight et al. | |
| 176,365 | A | * | 4/1876 | Simpson, T. F. | 84/429 |
| 246,805 | A | * | 9/1881 | Neuhaus, G. | 84/429 |
| 971,172 | A | * | 9/1910 | Clutsam, F. | 84/429 |
| 1,940,093 | A | * | 12/1933 | Lindridge | 84/706 |
| 2,567,870 | A | * | 9/1951 | Bozak et al. | 200/1 R |
| 3,070,371 | A | * | 12/1962 | Hearle | 273/287 |
| 3,746,820 | A | * | 7/1973 | Holder, Jr. | 200/251 |
| 3,818,114 | A | * | 6/1974 | Okamoto | 84/629 |
| 4,304,167 | A | * | 12/1981 | Tait | 84/429 |
| 4,684,091 | A | * | 8/1987 | Moreschi | 248/166 |
| 4,748,913 | A | * | 6/1988 | Favaretto et al. | 108/50.02 |
| 6,259,006 | B1 | * | 7/2001 | Parienti | 84/171 |
| D460,101 | S | * | 7/2002 | Juhe | D17/1 |
| 6,875,913 | B2 | * | 4/2005 | Bubar | 84/423 R |
| 6,894,211 | B2 | * | 5/2005 | Asahi | 84/423 R |
| 7,217,877 | B2 | * | 5/2007 | Funaki | 84/433 |
| 7,306,226 | B2 | * | 12/2007 | Gagnon | 273/242 |
| 7,361,826 | B2 | * | 4/2008 | Brun | 84/719 |
| 7,652,207 | B2 | * | 1/2010 | Osuga et al. | 84/433 |

(Continued)

OTHER PUBLICATIONS

Target Stores Keyboard, posted Apr. 7, 2010, viewed at http://www.matrixsynth.com/2010/04/target-stores-keyboard.html on Feb. 5, 2014.*

*Primary Examiner* — Robert W Horn
(74) *Attorney, Agent, or Firm* — Parker Ibrahim & Berg LLC; James M. Behmke; Stephen D. LeBarron

(57) ABSTRACT

According to embodiments herein, a circular, semi-circular, or generally rounded piano keyboard is shown and described. In particular, in an illustrative embodiment, the piano keyboard is a fully to nearly-fully circular stage piano keyboard that surrounds a keyboardist, allowing for up to 360 degrees of key-play. Other, e.g., wearable, embodiments of the circular piano keyboard are also described, such as a curved keytar or a curvaceous "keydress."

17 Claims, 22 Drawing Sheets

(56) References Cited

U.S. PATENT DOCUMENTS 7,790,972 B2 * 9/2010 Stewart ..... 84/423 R
7,928,312 B2 * 4/2011 Sharma ..... 84/719
2009/0266218 A1 * 10/2009 Parienti ..... 84/171

* cited by examiner

CIRCULAR PIANO KEYBOARD

RELATED APPLICATIONS

The present application claims priority to the U.S. Provisional Patent Application Ser. No. 61/586,111, entitled "Circular Piano Keyboard" filed by Parsons et al. on Jan. 12, 2012, the contents of which are incorporated herein in its entirety.

TECHNICAL FIELD

The present invention relates generally to piano keyboards, and, more particularly, to the shaping of digital piano keyboards.

BACKGROUND

As is well known, the piano is a musical instrument played by means of a keyboard. In a conventional piano, pressing a key on the piano's keyboard causes a felt-covered hammer to strike steel strings. The hammers rebound, allowing the strings to continue vibrating at their resonant frequency. These vibrations are transmitted through a bridge to a sounding board that more efficiently couples the acoustic energy to the air. When the key is released, a damper stops the string's vibration. The invention of the modern piano is credited near the year 1700 to Bartolomeo Cristofori (1655-1731) of Padua, Italy, who was employed by Ferdinando de' Medici, Grand Prince of Tuscany, as the Keeper of the Instruments.

In the period lasting from about 1790 to 1860, the piano underwent tremendous changes that led to the modern form of the instrument. This revolution was in response to a preference by composers and pianists for a more powerful, sustained piano sound, and made possible by the ongoing Industrial Revolution with resources such as high-quality piano wire for strings, and precision casting for the production of iron frames. Over time, the tonal range of the piano was also increased, e.g., from five octaves to the 7⅓ or more octaves found on modern pianos. Various other improvements also came slowly over the years, such as felt hammer coverings, double escapement action, the sostenuto pedal, a "choir" of three strings, an over-strung scale (also called "cross-stringing"), duplex scaling, etc.

In addition, some early pianos had shapes and designs that are no longer in use. For instance, the square piano (actually rectangular) was cross strung at an extremely acute angle above the hammers, with the keyboard set along the long side. Moreover, other designs included an upright grand, a cabinet piano, a short cottage upright piano or pianino with vertical stringing (informally called birdcage pianos), an oblique or diagonally strung upright, a tiny spinet upright, etc. Further designs also included giraffe, pyramid, and lyre pianos, which were arranged in a somewhat similar fashion in evocatively shaped cases. Modern upright and grand pianos attained their present forms by the end of the 19th century.

With the advent of modern technology, electronics have played a major role in recent advances in piano design. In particular, in addition to electric pianos, which simply use electromagnetic pickups to amplify the sound of the strings of a conventional piano, digital pianos use technology (e.g., digital sampling) to electrically reproduce the sound of each piano note, rather than using actual strings (e.g., metal tines, reeds, or strings hit by a hammer). Digital pianos can be sophisticated, with features including working pedals, weighted keys, multiple voices, and MIDI interfaces. That is, a digital piano is a modern electronic musical instrument, meant generally to provide an accurate simulation of a real piano, and may include a variety of piano timbres and many more instrument sounds including strings, guitars, organs, and more.

For instance, most digital pianos can be connected to a computer, e.g., using the MIDI interface. With appropriate software, the computer can handle sound generation, mixing of tracks, music notation, musical instruction, and other music composition tasks. Though piano-style musical keyboards are called "keyboards," regardless of their functions or type, keyboards and other devices used to trigger musical sounds are often called "controllers," because with most MIDI set-ups, the keyboard or other device does not make any sounds by itself. That is, controllers (or MIDI controllers) need to be connected to a voice bank or sound module in order to produce musical tones or sounds.

Furthermore, some digital pianos incorporate other basic "synthesizer" sounds such as string ensemble, and offer settings to combine them with piano. A sound synthesizer (often abbreviated as "synthesizer" or "synth"), for instance, is an electronic instrument capable of producing a wide range of sounds, which may either imitate other instruments or generate new timbres. Synthesizers are often controlled with a piano-style keyboard, leading such instruments to also be referred to simply as "keyboards."

Yet another form of piano/keyboard is the "stage piano," designed for use with a live band. Stage pianos often have a heavier, more robust body, which is better able to withstand the stress of heavy touring. Unlike digital pianos designed for home use, they do not have a fixed stand or fixed sustain pedals. Instead, they are designed to be used with a separate portable stand and portable sustain pedals, to aid in transportation between shows.

The physical form of a digital piano can vary considerably. Most vaguely resemble a low upright piano (e.g., without an enclosed lower section), while still others are based on the casework of traditional upright or grand instruments. Other types of digital pianos, such as the controllers, keyboards, synthesizers, stage pianos, etc., generally merely comprise various encasement designs to house the necessary physical components (e.g., keys, action mechanisms, etc.) and electronics, placed on some type of stand. Despite their variations in design of their external housing, however, all digital piano keyboards are currently based on the typical arrangement and orientation of traditional piano keys. That is, all of their keys are parallel, planar, and linear.

SUMMARY

According to one or more embodiments of the invention, a circular, semi-circular, or generally rounded piano keyboard is described, where the shape, size, orientation, and action of the keyboard may be arranged in order to allow for comfortable key-play, whether on stage or in the home. In an illustrative embodiment, the piano keyboard is a fully to nearly-fully circular stage piano keyboard that surrounds a keyboardist, allowing for up to 360 degrees of key-play. In another embodiment, the piano keyboard is a 90-degree digital piano that may be placed in the corner of a room. According to various aspects of the embodiments herein, the number of keys, arrangement of multiple divisions of keyboards (e.g., controller configurations), placement of non-keyed controls (e.g., mod wheels, pitch wheels, etc.), may also be described, accordingly. Wearable embodiments of the circular piano keyboard are also shown and described.

BRIEF DESCRIPTION OF THE DRAWINGS

The embodiments herein may be better understood by referring to the following description in conjunction with the accompanying drawings in which like reference numerals indicate identically or functionally similar elements, of which.

DETAILED DESCRIPTION OF EXAMPLE EMBODIMENTS

The general concept of the invention herein is based on having a playable piano keyboard, such as for a digital piano, stage piano, etc., that is curved generally around an axis at or near the player. In this manner, a player has more keys at his or her disposal, more functionality, and, if so desired, more stage presence.

Figure 1A:
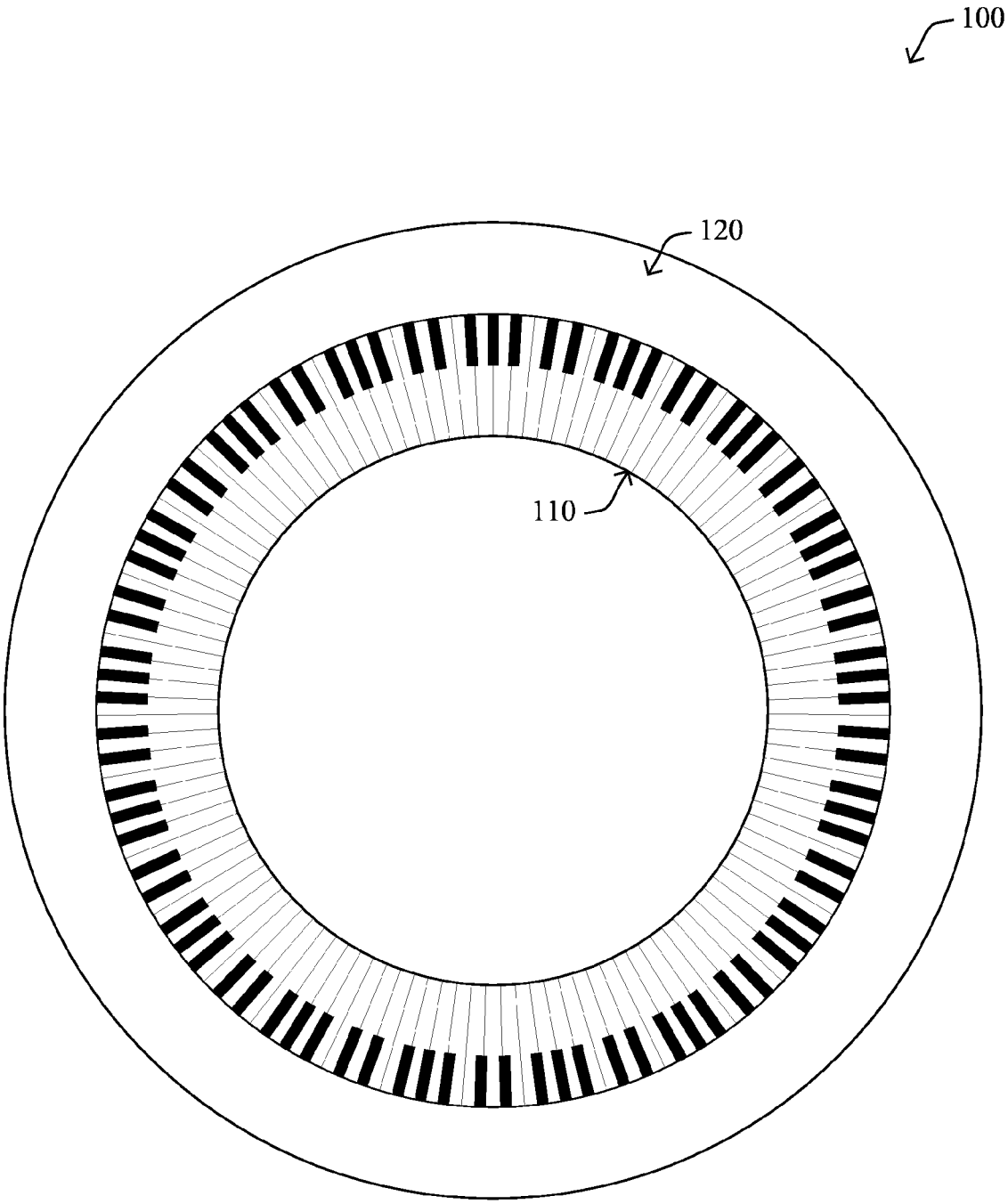
FIGS. 1A-1B illustrate an example circular piano keyboard.
Figure 1B:
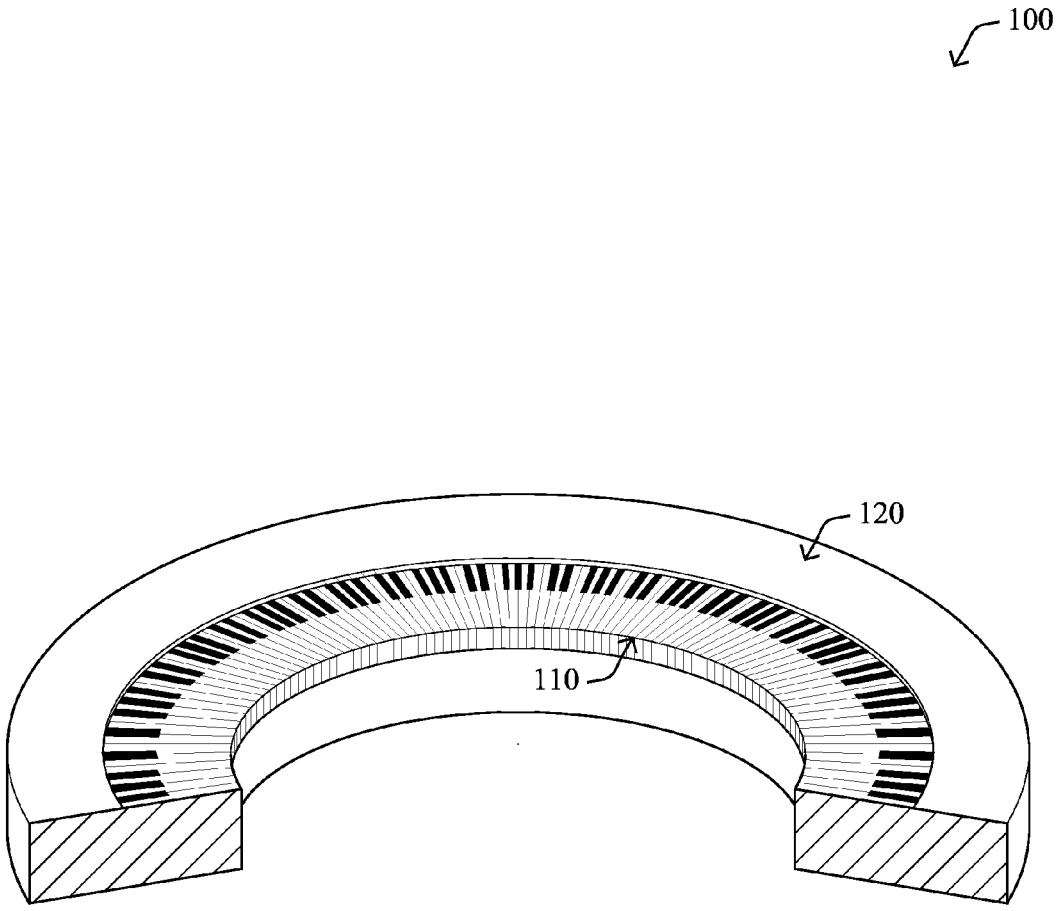

As shown in the aerial view of FIG. 1A, an illustrative embodiment of the invention comprises a circular piano keyboard 100 that substantially (e.g., completely) surrounds the player (i.e., pianist, keyboardist, musician, etc.). The keyboard 100 has a plurality of keys 110 (at least the number of which not being necessarily to scale), which may be generally sized according to standard piano keys, and arranged according to a conventional scale of natural and accidental keys (e.g., "white" and "black" keys), however, unlike conventional parallel keys, the keys 110 radially extend away from a central reference point near to the player of the keys. The keys 110 may be generally continuous, that is, without breaks (other than for alternative embodiments described below), such that there is substantially no perceptual beginning or end to the keys in a fully-circular arrangement (other than optional visual cues to assist the player's orientation, e.g., as described below). Also, a housing 120, e.g., for key mechanics and/or electronic components, may further surround the keys 110 to generally create the "case" or "body" of the keyboard 100. FIG. 1B illustrates a partial side-aerial view of the keyboard 100, for example, as may be viewed from a player while positioned within the keyboard.

The size of the circular piano keyboard 100 may generally be based on an average arm reach of a player (e.g., from a comfortable playing position), or else specifically based on a particular player of the keyboard. As an example, the inventors have found that a comfortable diameter, when measured from the edges of the accidental keys (e.g., "from sharp to sharp," position 310A in FIG. 3 below), is about 52 inches (+/−4 inches) for a six-foot tall player who plays while standing. Accordingly, the radial curvature of the piano keyboard 100 may be based on a 26-inch radius to the general playing location of the keys. Notably, should the circular piano be configured for playing while seated, or else otherwise configured for shorter players, the diameter may be reduced, accordingly.

Figure 2A:
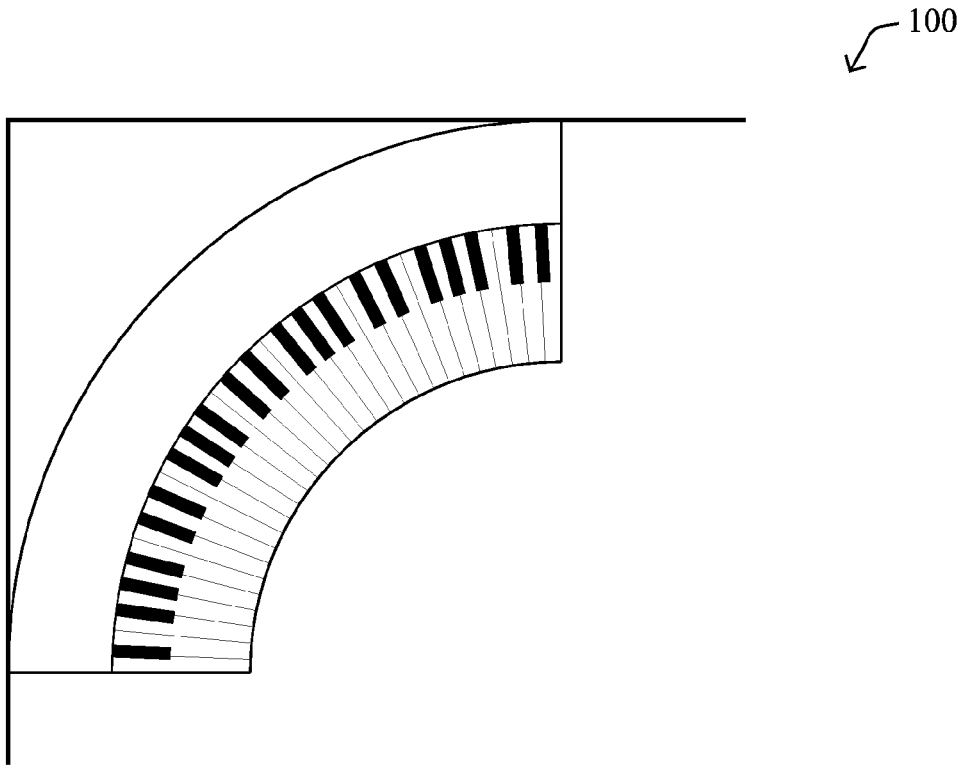
FIGS. 2A-2D illustrate example alternative curvature embodiments of a circular piano keyboard.
Figure 2B:
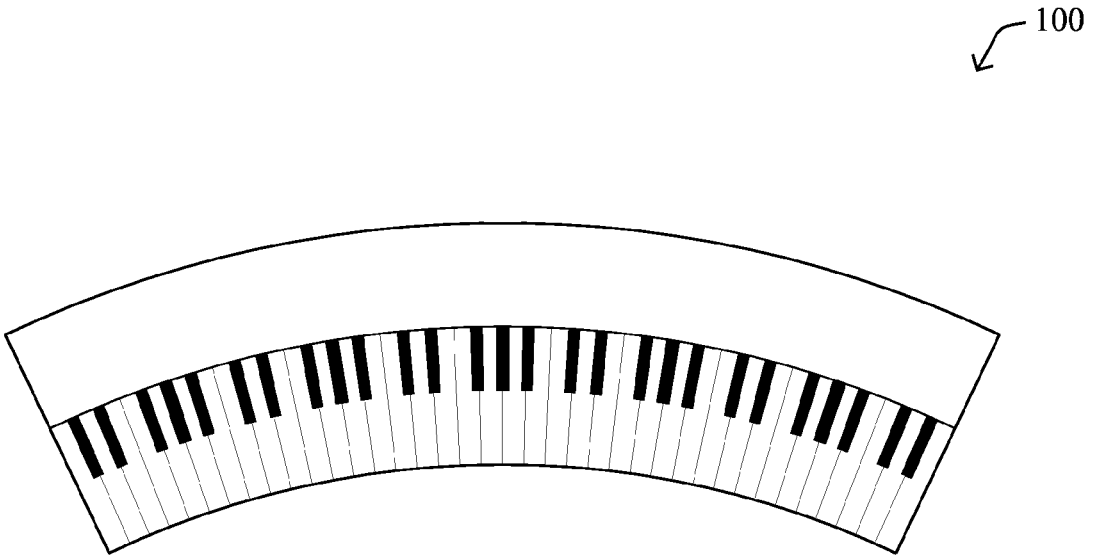
Figure 2C:
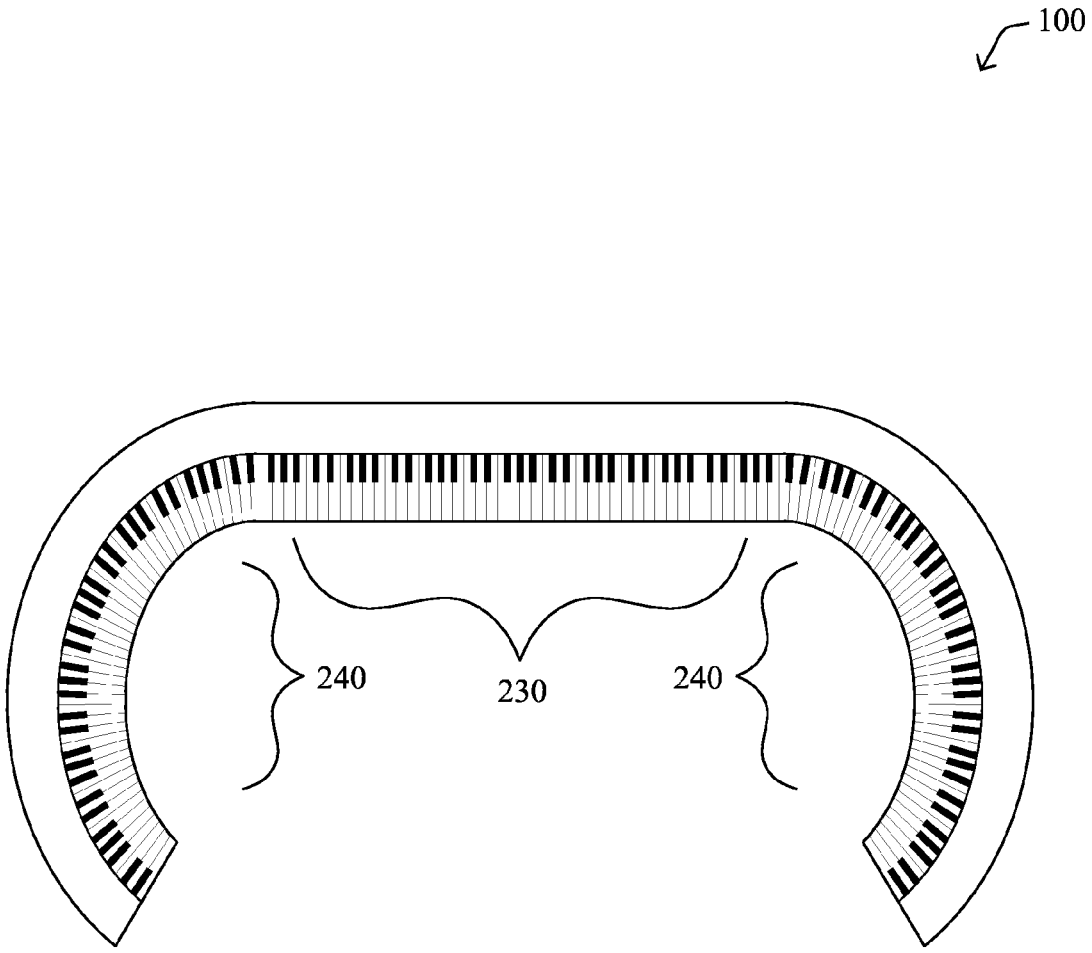
Figure 2D:
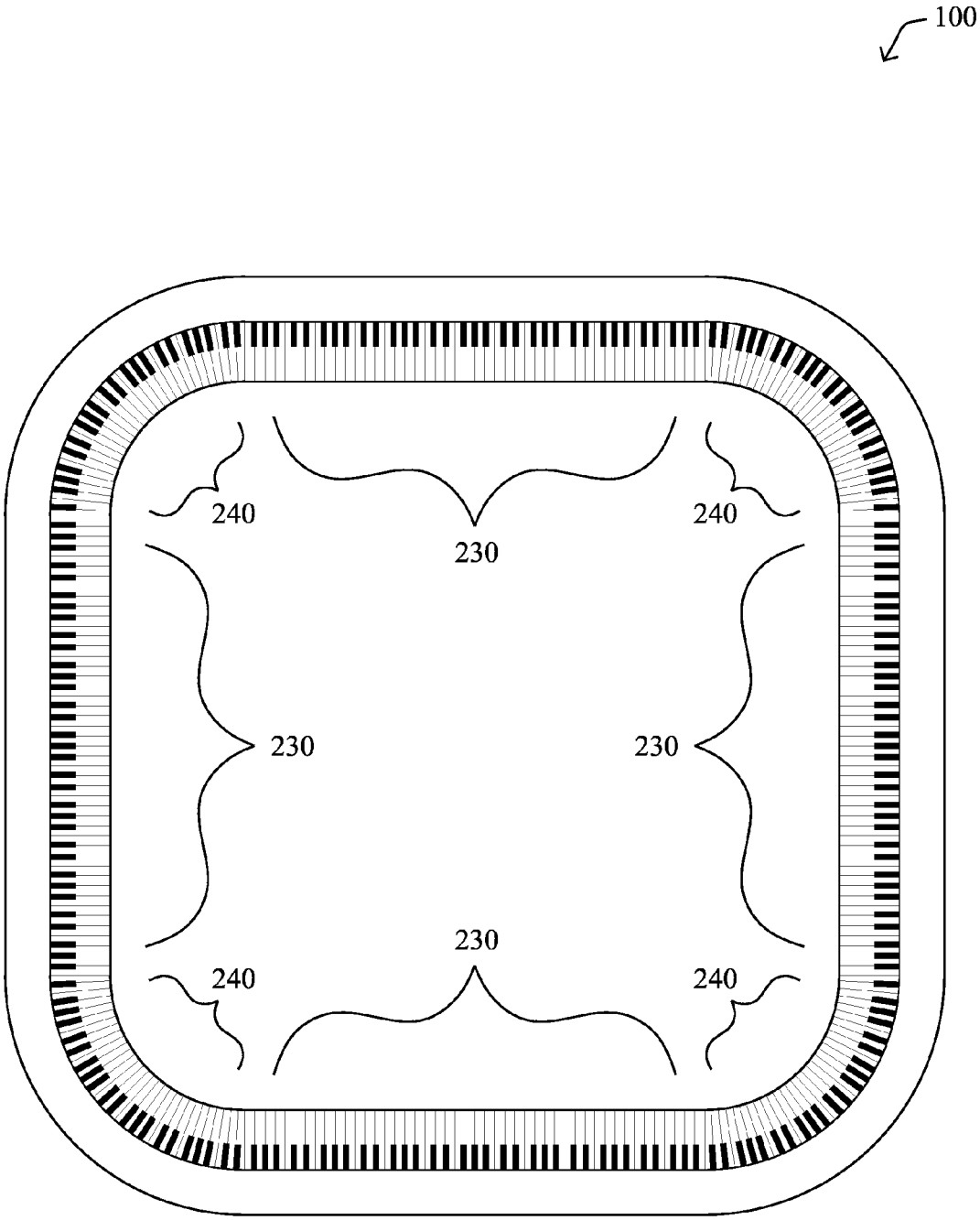

While FIG. 1A illustrates a fully-circular keyboard 100, the circular piano keyboard may consist of various alternative curvatures or shapes, such as shown in FIGS. 2A-2D. For instance, FIG. 2A illustrates an example embodiment where the circular piano keyboard 100 is in the form of a "corner" curved piano, e.g., to fit a standard 88-key piano into the corner of a room. Further, FIG. 2B illustrates how in certain embodiments the keyboard 100 may be oval (and not necessarily fully surrounding of the player). Further still, FIG. 2C illustrates the instance where a portion 230 of the keyboard 100 is straight (parallel keys 110), while one or more other portions 240 of the keyboard 100 are curved/circular. Moreover, FIG. 2D illustrates how the keyboard 100 may consist of a plurality of straight portions 230 and a plurality of curved portions 240, for example, making more of a "rounded corner square" piano keyboard as shown. Other curvatures, alone or in combination with straight portions 230, may also be used in accordance with the invention herein.

Figure 3:
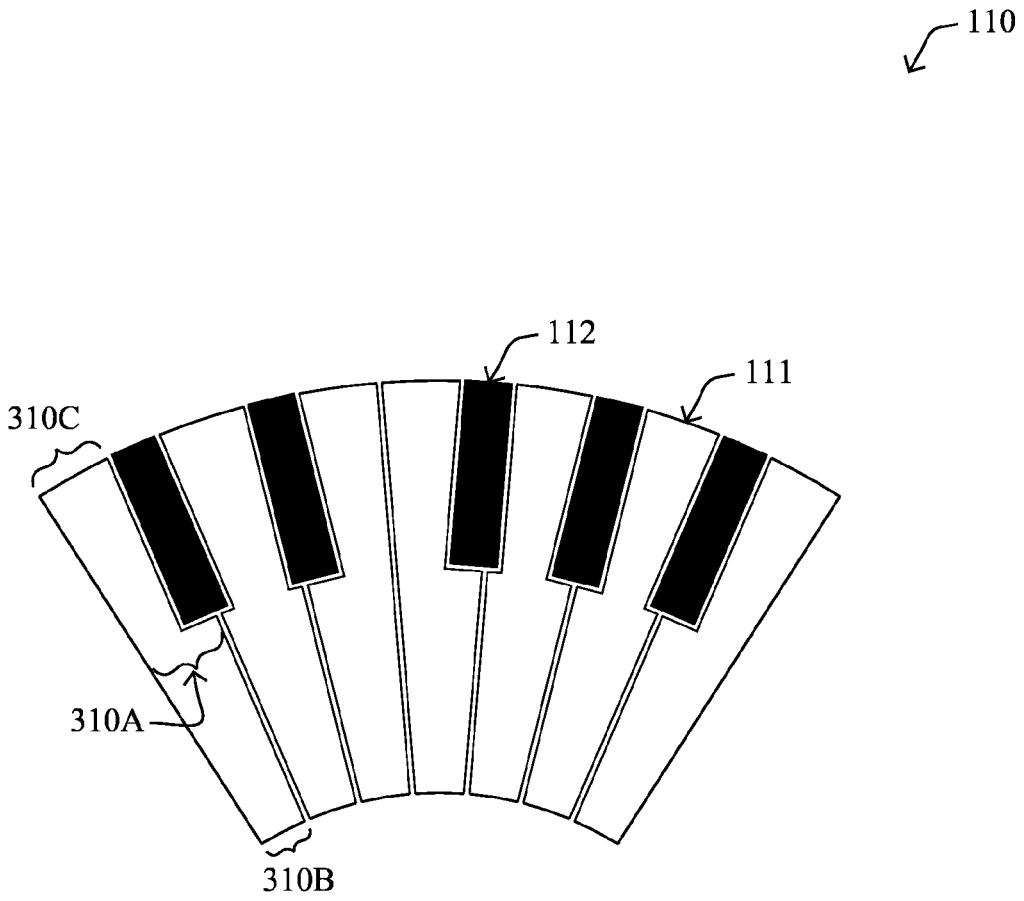
FIG. 3 illustrates an example key sizing of an illustrative circular piano keyboard.

In order to provide a similar feel to a skilled pianist, an illustrative embodiment of the circular piano keyboard sizes and spaces the keys 110 such that they have a substantially proper "feel" at the general location where fingers touch the keys. FIG. 3 illustrates an example key sizing of an illustrative circular piano keyboard, with noted positions 310A, 310B, and 310C, respectively located at the edge of the accidental keys 112 (sharps/flats or "black" keys), near the front edge of the natural keys 111 ("white" keys), and the rear edge of the keys 111 and 112. By maintaining a generally conventional key spacing at location 310A closest to average finger placement during play of a conventional keyboard, the ability to play a curved keyboard should be less cumbersome, having primarily to adjust arm movement, rather than finger movement, from conventional play of a straight keyboard.

For example, modern piano keyboards ordinarily have an octave span of approximately 6.48 inches; resulting in the width of black keys averaging 0.54 inches and white keys about 0.93 inches wide at the base, disregarding space between keys (a white key width itself may be 0.86 inches, for example). As such, an illustrative embodiment herein substantially maintains those expected conventional dimensions at play location 310A. Accordingly, in order to accommodate the fact that the keys 110 are relationally angled (i.e., non-parallel) for the curved/circular nature of the keyboard 100, the natural keys 111 toward the end 310B may be tapered inward (i.e., less than their width at location 310A). Note that since the ends of the accidental keys 112 are at location 310A, there may be no need to taper inward the accidental keys. In addition, to optionally remove unnecessary gaps at location 310C, the keys 111 (and optionally 112) may be widened.

Having an illustrative circumference of approximately 163.4 inches at location 310A, the number of continuous natural keys 111 in a full circle would be approximately 176. Most conventional pianos have 52 natural/white keys and 36 accidental/black keys for a total of 88 keys (seven octaves plus a minor third, from A0 to C8). Some pianos, for example, extend the normal range down to F0, with one other model going as far as a bottom C0, making a full eight octave range. 102 key pianos (black and white keys) allow a frequency range that extends from C0 to F8, which is generally considered the widest practical range for an acoustic piano. With 176 natural keys, and assuming a rough ratio of five accidental keys to every seven natural keys, this results in an illustrative circular piano with approximately 300 keys. (Note that for the embodiment in FIG. 2A above, a standard number of keys, e.g., 88, may be used. For other, non-fully-encircling, or other sizes of keyboards, would result in a different number of keys, as well.)

Figure 4A:
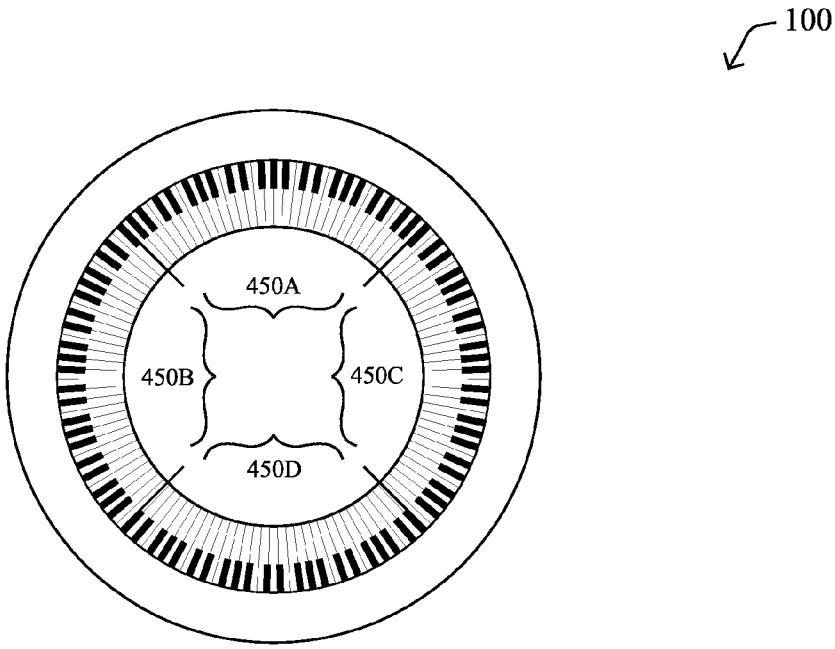
FIGS. 4A-4C illustrate examples of keyboard divisions for an illustrative circular piano keyboard.

Having 300 available keys equates to approximately 3.5 full size (88-key) piano keyboards. While the scale of the keyboard may be changed to more than twelve keys per octave, such as for microtonal music, according to one or more illustrative embodiments herein, the full keyboard 300 may be partitioned into a plurality of "keyboard divisions." For example, as shown in FIG. 4A, a plurality of keyboard divisions 450 may be defined, e.g., hard-configured (unchanging) or else soft-configured (configurable by software or other mechanisms), such as divisions 450A, 450B, 450C, and 450D. In one specific embodiment, a central (e.g., front) division 450A may comprise a standard 88-key keyboard, while the remainder of the keys may be arranged and configured in any number of corresponding divisions 450.

Note that the different divisions 450 need not produce different sounds, for example, hitting one key on one division 450 may produce a same sound as hitting another key on another division 450. This may be particularly useful for multiple player configurations as mentioned herein, or else for ease of use to simply have the circular piano keyboard be an aesthetic device, where the same notes and/or song can be played by the player facing in different directions or reaching across in different, e.g., opposing, directions, such as the left hand playing on division 450B and the right hand playing on division 450C, just as if they were playing the arrangement on a standard piano with their left and right hands in front of them, accordingly.

The keyboard divisions may have any suitable number of keys 110, and may be so divided in any manner desired by the player, if configurable. For example, certain divisions 450 may be piano sounds, while another division is used for strings, and another for percussion, and another for synthesizer sounds, etc. In fact, one division 450 may even be used to control the lights on a stage.

Figure 4B:
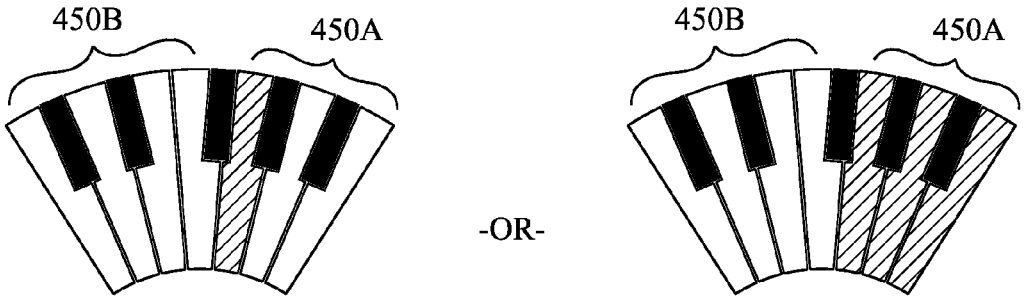
Figure 4C:
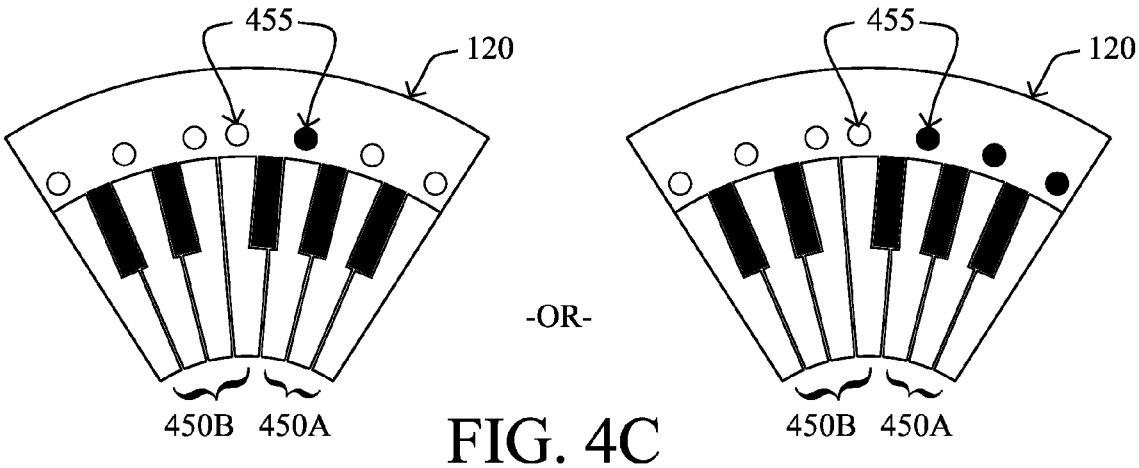

In the event the divisions are hard-configured, visual indications may be made on the keys 110 and/or housing 120 to indicate the partition/breaks between the keyboards to the player. For example, different colored keys per division, a different colored key at he beginning and/or end of a division, etc., may be used. FIG. 4B, for example, may illustrate such a colored key/indicator to show the border between two keyboard divisions 450, or else the different coloration of all of the keys of another keyboard (e.g., inverting the black and white key coloring, or using any other color combination).

Alternatively, when the keyboard divisions 450 are configurable, then a dynamic indication of the divisions may also be used. For example, FIG. 4B may show the lighting of keys (e.g., where the keys are configured to light up) to differentiate between the configured keyboard divisions 450. (Note that where the keys are configured to light up, it may be possible to have the keys light up as you play them.) In another embodiment, the housing 120 may comprise various indications, such as lights (e.g., LEDs, etc.) 455 that may be illuminated to provide a visual indicator to the player for the keyboard divisions 450, accordingly. When the keyboard division configuration is changed, the corresponding lighting scheme may also change to match the new division layout. (Note that the configuration of the divisions, and the corresponding illumination control, may be managed by controller interfaces, described below.)

As will be understood by those skilled in the art, the piano action mechanism, or the key action mechanism, or simply the "action" of a piano or other musical keyboards, is the mechanical assembly which translates the depression of the keys of a string piano into rapid motion of a hammer, which creates sound by striking those strings. The key action mechanism determines weighted keys feeling, that is the feeling of the heaviness of the touch of the keys. A conventional digital piano's keyboard is weighted to simulate the action of a traditional piano, as will be understood by those skilled in the art. Fully weighted keys are designed to replicate the weight and playing action of acoustic piano hammer-action keys. Other types of weights, such as semi-weighted keys (to save overall weight) or sprung keys are also available.

Figure 5A:
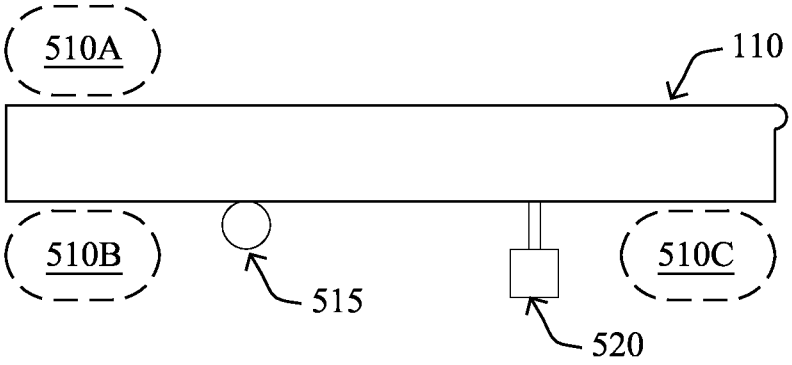
FIGS. 5A-5G illustrate simplified examples of key action and spacing for an illustrative circular piano keyboard.

FIG. 5A illustrates a greatly simplified side-view example of key action for an illustrative circular piano keyboard in accordance with one or more embodiments herein. For example, each key 110 (whether natural 111 or accidental 112) may have one or more action mechanisms 510, such as one above the back of the key (510A), one below the back of the key (510B), and/or one at the front of the key (510C). In addition, the key 110 generally pivots about a point 515, which may be a rod through the key 110 or simply a ledge on which the key rests (as a lever).

The action of a key is velocity-sensitive, so that the volume of the sounds depends on how fast the keys are pressed. For digital pianos, one or more velocity sensors 520 may be used to pick up the velocity of the key depression, as will be appreciated in the art. For example, in one embodiment, the sensor 520 consists of two (or more) location sensors, and software detects the time at which the key passes each of the location sensors to determine the corresponding velocity. Alternatively, an optical sensor may be used to detect the position of the key 110, where a sufficient sample rate allows for detection of the velocity as well. Note that either type of sensor 520 may also allow for what is referred to as "after-touch," which is an additional pressure on an already depressed key (e.g., into the underlying padding/felt beneath the key) to produce a further action (sound) from the key.

Figure 5B:
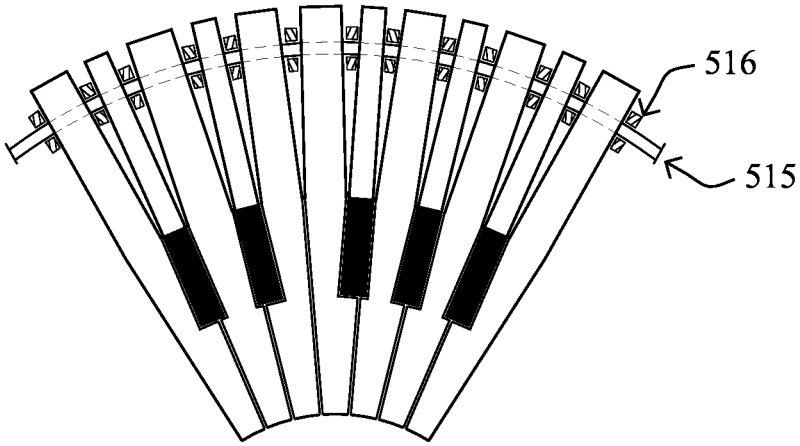

In addition, FIG. 5B illustrates an example of action spacing between the keys 110 of an illustrative circular piano keyboard. In particular, in certain embodiments, the pivoting action of the keys is based on the keys sharing a rod as pivot point 515. In order to curve or otherwise "bend" that rod (515), since it generally rests behind location 310A, results in a gap between the keys 110. As such, one or more spacers 516 may be used between the keys as shown in order to maintain their overall stability around the pivot point 515 when a shared rod is used.

Figure 5C:
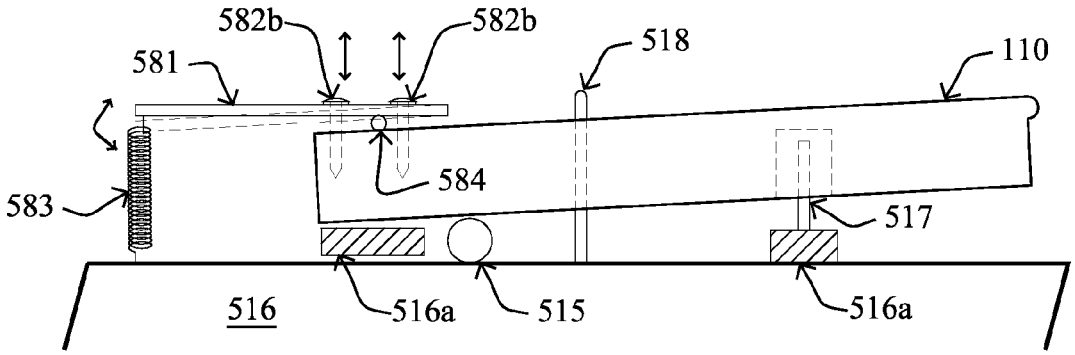
Figure 5D:
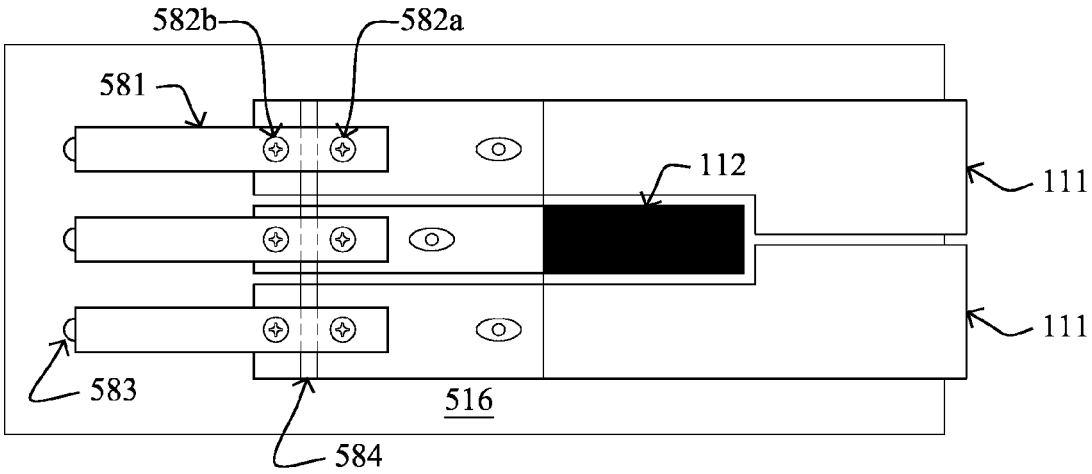

According to one or more embodiments of the invention, FIGS. 5C-5D illustrate a specific novel key action mechanism (from the side and top, respectively) that may be particularly well suited for creating the circular piano keyboard herein. (Note, however, that the embodiment shown in FIGS. 5C and 5D is not limited to use in a circular keyboard, and may, in fact, be used in conjunction with any shaped keyboard, including, but not limited to, conventional straight keyboards.)

As shown in FIGS. 5C-5D, a side-view illustration of the developed key action provides for each key 110 (whether natural 111 or accidental 112) to have generally conventional key movement mechanisms, such as pivoting about a point 515 as described above, and in more detail than shown above, connecting with the underlying structure 516 (and separated by felt/padding 516*a*) via a front a rear pin member 517 and 518, respectively. According to the illustrative embodiment, action mechanism 580 (generally at location 510A of FIG. 5A, though in certain configurations possible at location 510B) comprises an extended lever 581, which may be attached to the key 110 via one or more screws 582 (or other suitable fastener). At an opposing end of the lever 581, one or more springs 583 may be attached to both the lever 581 and the underlying structure 516 to provide for sprung key action. That is, as the key 110 is depressed and pivoted about point 515, the lever 581 thus pulls upward on spring 583. When the key is released, the tension in the spring returns the key to its original position. Note that one or more "key stops" (not shown) may be placed above the keys 110 in a position between the pivot point 515 and the front edge of the key (preferably hidden from view) in order stop the upward return motion of the key.

In one specific embodiment as shown, fine-tuned adjustment of the spring 583 may be accomplished by adjusting the screws 582*a* and 582*b* in generally alternating manners to pivot the lever 581 about a pivot point 584, which may be a separate component or may be integral to lever 581 (e.g., by shaping the lever or adding material to the lever, accordingly). In this manner, the angle of the lever may be adjusted with relation to the key 110 (shown in shadow/dashed lines), thus adjusting the overall pre-sprung tension (weight) of the corresponding spring(s) 583. Notably, though a pivoting lever 581 is shown as one manner to adjust the spring tension, other techniques will be readily apparent to those skilled in the art, such as having a stationary lever and independently adjustable springs (e.g., turn-screw spring tensioners).

Figure 5E:
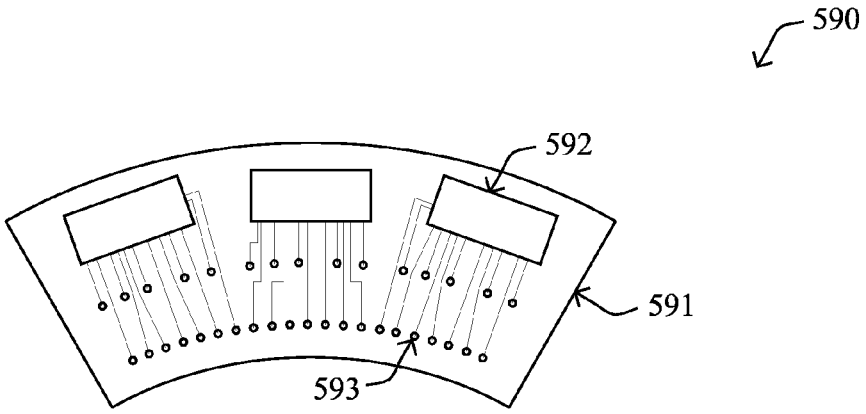
Figure 5F:
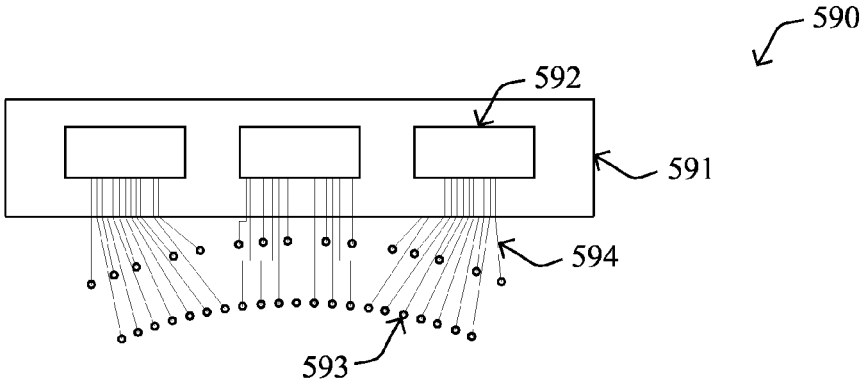
Figure 5G:
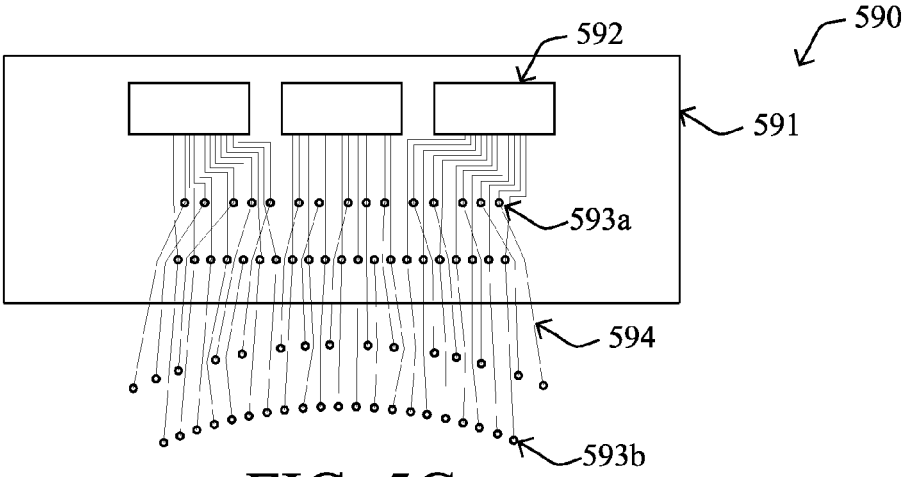

In addition, given the curvature of the circular keyboard, the communication of the sensors 520 may also benefit from special provisioning as described herein. In particular, conventional keyboards are straight, and as such, corresponding circuitry is also relatively straight, and straightforward. FIGS. 5E-5G illustrate example embodiments for physically placing the "sensors 520" of FIG. 5A above.

For instance, as shown in FIG. 5E, sensor circuitry 590 may comprise a curved circuit board 591, having one or more locations for various chipsets of software processors 592 configured to receive and process sensing signals from individual sensors 593 (similar to sensors 520 above). As shown, each key 110 would have a corresponding sensor 593, such as a physical velocity sensor or else an optical velocity sensor, which may transmit electrical signals via the circuit board to processing units 592 for conversion to a trigger signal or sound.

Notably, though there is a certain number of processors 592 shown, this number, as well as their connection to a certain number of sensors 593, is merely an illustrative example meant to illustrate the components generally on a curved circuit board 591. For example, while three processor modules 592 are shown, any number may be used, such as one per keyboard (for all of the keys), one per separable keyboard component (described below), one per 12-key octave, one per key, etc. Generally, where multiple processing units 592 are used, a central unit (not shown) may be used to interface with external components, e.g., to assimilate the key signals of the entire keyboard and transmit them via an appropriate interface (e.g., MIDI).

Conversely, FIG. 5F illustrates an example of a straight circuit board 591, where the processing modules 592 are configured to communicate via jumpers/wires 594 with sensors 593. In this manner, the difficulties associated with creating a rounded circuit board may be minimized, and each sensor 593 may be placed beneath the keys 110 in respective locations. Given the fact that the keyboard 100 is rounded, however, multiple straight circuit boards 591 may be required in order to create an encircling shape around the keyboard 100, and as such, those circuit boards may be interconnected with a communication link as well (not shown). Note that in FIG. 5F, the remotely located sensors 593 (remote from the circuit board), may be simply sensor circuitry for processing by the main circuit board 591, or else may be more intelligent, e.g., having processing of its own (e.g., it's own mini-circuit board and processor) to determine the velocity, and send that processed signal to the aggregating processor modules 592.

Lastly, FIG. 5G illustrates a retrofitting example that may be utilized, where a straight circuit board 591 that may be used with a conventional (straight) keyboard is modified with jumpers/wires 594 to allow for the remote-locating of sensors 593*a* to their new location on a circular keyboard as sensors 593*b*. In this manner, "sensors 593*a*" are not velocity sensors, but are instead converted into electrical (or optical) connectors to allow communication between the actual sensors 593*b* with the circuit board 591.

Notably, though the sensors 593 are generally shown aligned to key placement in FIGS. 5E-5G, that is, whether the sensor is beneath an accidental or natural key, it is possible in certain embodiments to align the sensors along a shared radius between both accidental and natural keys. In this manner, a single "line" of sensors may be arranged in succession along a curve in order to pick up motion of both the natural and accidental keys.

Figure 6A:
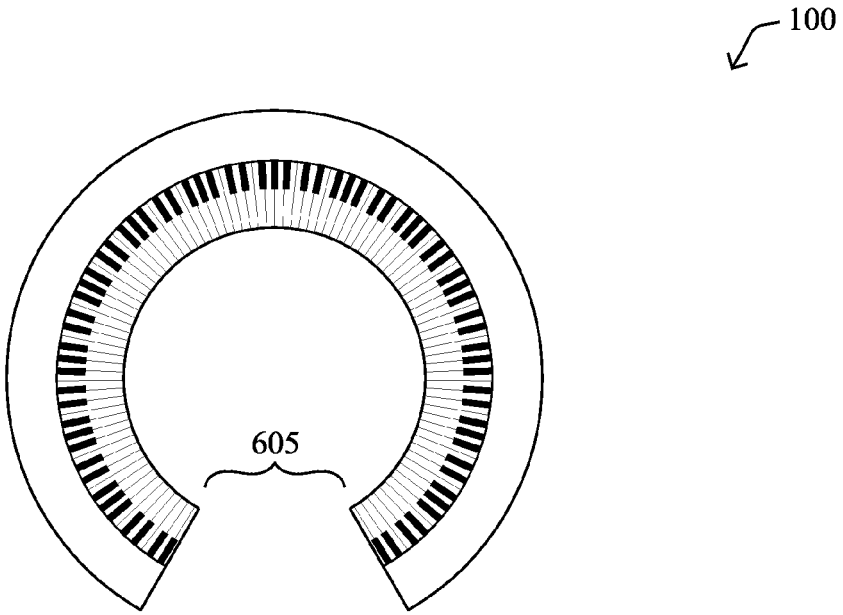
FIGS. 6A-6B illustrate example entrances for an illustrative circular piano keyboard.
Figure 6B:
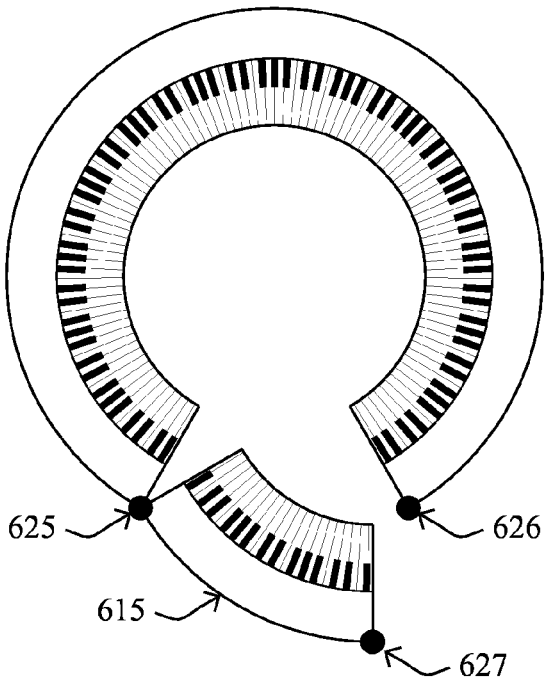

According to one or more embodiments herein, when the keyboard 100 is fully surrounding the player, a variety of embodiments of the keyboard have been designed to allow for adequate ingress and egress of the player. For example, rather than simply climbing over or under the keyboard 100 (or else being more dramatically lowered or raised into, as if on a stage tour), as shown in FIG. 6A a portion (e.g., the rear) of the keyboard may be left open, where such an opening (aperture 605) is sized to allow for the passage of the player, accordingly. On the other hand, in order to allow the complete encircling of the player by the keyboard, as shown in FIG. 6B a portion 615 of the keyboard 100 may be made to specifically pivot out on a hinge 625, with mating latching mechanisms 626 and 627 on an opposing side of the keyboard 100 and portion 615, respectively. Alternatively, in FIG. 6B, the portion 615 may be removable, rather than hinged. Note that portion 615 may be a functional part of the keyboard 100 (that is, has keys that may be played), or else may be a "dummy" portion of the keyboard 100 to merely provide a fully encircled look (e.g., where three full-sized keyboard divisions 450 are used, the last half or so keyboard space may be simply used as a gate/door).

Figure 7A:
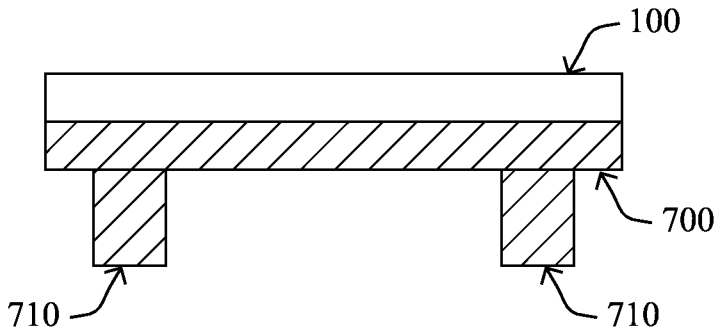
FIGS. 7A-7C illustrate an example adjustable stand for an illustrative circular piano keyboard.
Figure 7B:
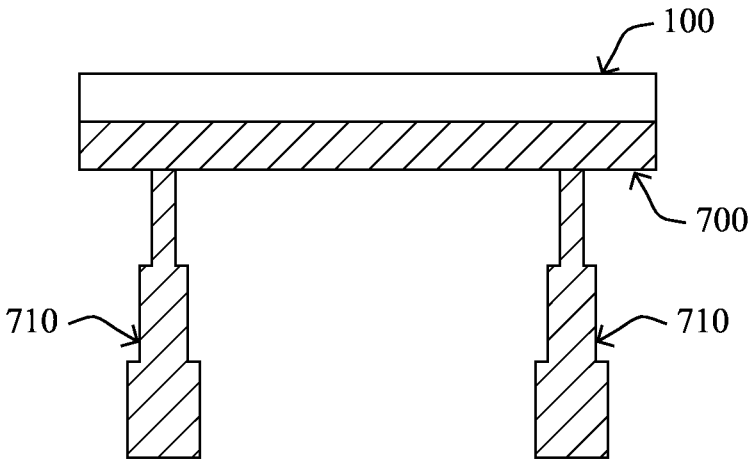
Figure 7C:
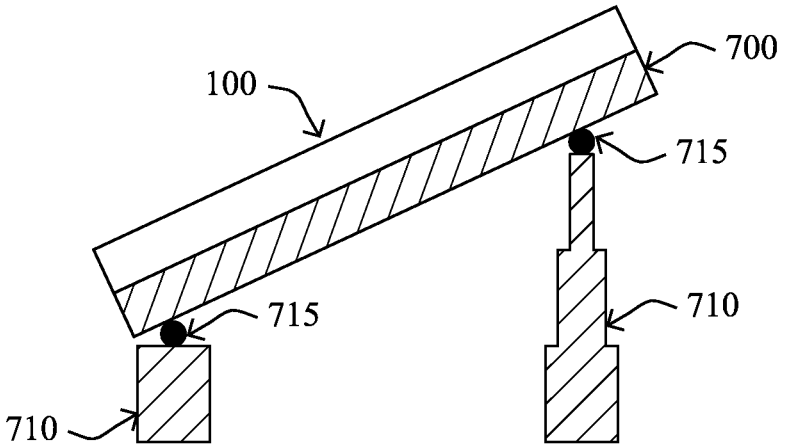

In addition, given an adjustable stand as in the embodiment shown in side-view in FIGS. 7A-7C, e.g., hydraulic or otherwise, it may be possible to start with the stand 700 in a lowered position (FIG. 7A), step over the keyboard 100, then raise the stand (FIG. 7B) to a comfortable playing height. The stand 700 itself may comprise a plurality of "legs" 710 (e.g., three or four), as may be readily appreciated. Note also that the legs may be raised to different heights, as shown in FIG. 7C, such that a suitable connecting member 715 (e.g., pivots, joints, etc.) allow the keyboard to be tilted, such as to show the keys to an audience while playing the keyboard on stage. Alternatively in FIG. 7C, one leg (or more) may be configured to adjust its height, while the remaining legs may remain stationary and hinged, such that motion of the single leg (or more) tilts the plane of the entire keyboard, accordingly.

Figure 8A:
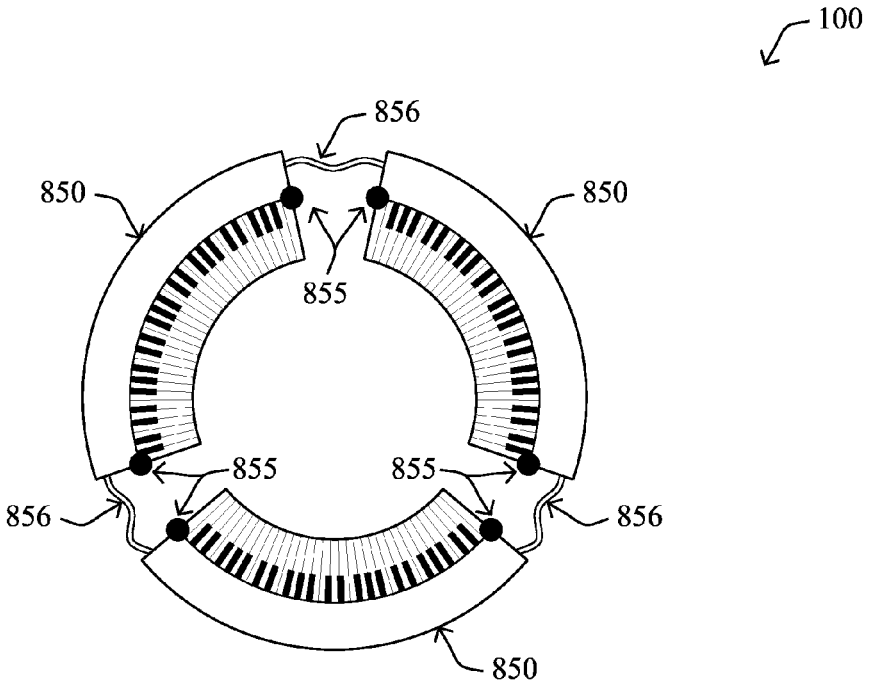
FIGS. 8A-8D illustrate an example of separable and/or hinged components of an illustrative circular piano keyboard.

To assist in portability and travel of the keyboard 100, the entire assembly of the keyboard may consist of a plurality of physically separable components 850, as illustrated in FIG. 8A. For instance, the keyboard 100 may be separated into two, three, four, or more components 850, and then interconnected by physical interlocks 855. Note that the separable components 850 may be directly based on the keyboard divisions 450 (or else vice versa). For example, in one illustrative embodiment sized as described above, three full-size 88-key keyboards (controllers) may create the separable components 850, with a fourth smaller section (e.g., a 20-30 key keyboard/controller) may be used to complete the circle. In this particular embodiment, the three 88-key keyboard components may be used as individual 88-key controllers, and the fourth "keystone" piece may be used as an individual controller for separate sounds, MIDI control, function control, etc.

Interlocks 855, in particular, may comprise latches, hooks, "clicking" mechanisms, etc. Note also that the interlocks 855 may incorporate electronic connections 856 as well to interconnect various electronics associated with the keyboard 100, or else such electronic connections 856 may be entirely separate from the interlocks 855 (e.g., as jumper wires, or separate mating plugs, etc.). For example, the electronic connections, such as MIDI wires or USB (universal serial bus) wires may be individual wires, or may interconnect through an electronic hub device (not shown) to create a single output wire to a controller interface.

Figure 8B:
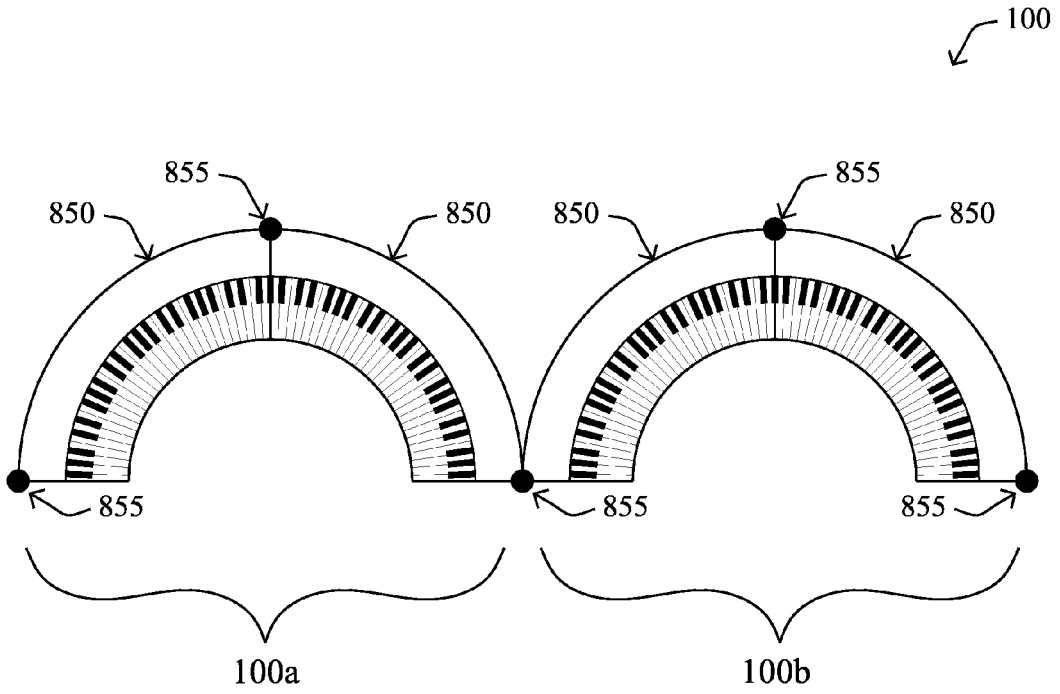

In one illustrative embodiment, the interlocks 855 may comprise hinges or otherwise pivoting connectors. For instance, as shown in FIG. 8B, the interlocks (hinges) 855 may allow for ease of assembly of the components 850, or else may also allow for alternative configurations of the keyboard 100. As an example, by leaving one interconnect open, and an opposite interconnect hinged at 180 degrees, two semi-circle connected keyboard portions 100*a* and 100*b* may allow for multiple simultaneous players of the keyboard. Similar configurations may be made for three or more players, depending upon the number of components 850 that make up the keyboard 100.

Note also that multiple players may also locate themselves within the closed keyboard 100, e.g., encircling the players in a generally back-to-back orientation for two players (or back-to-back-to-back for three players, etc.), whether or not the components 850 are configured to hinge and/or separate.

Figure 8C:
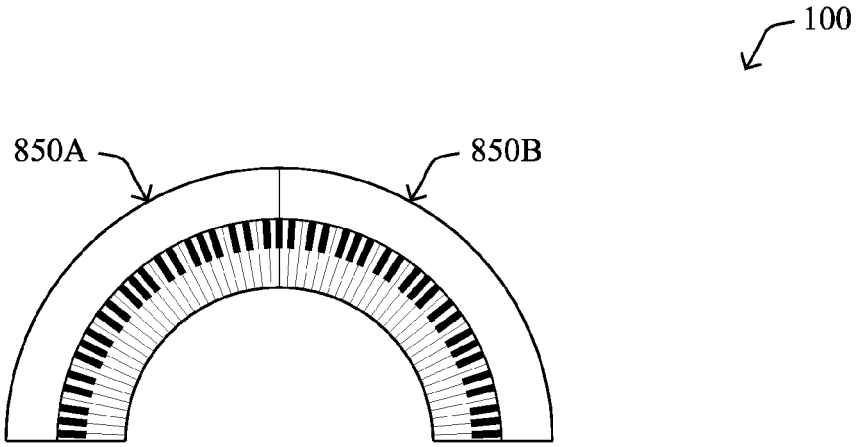
Figure 8D:
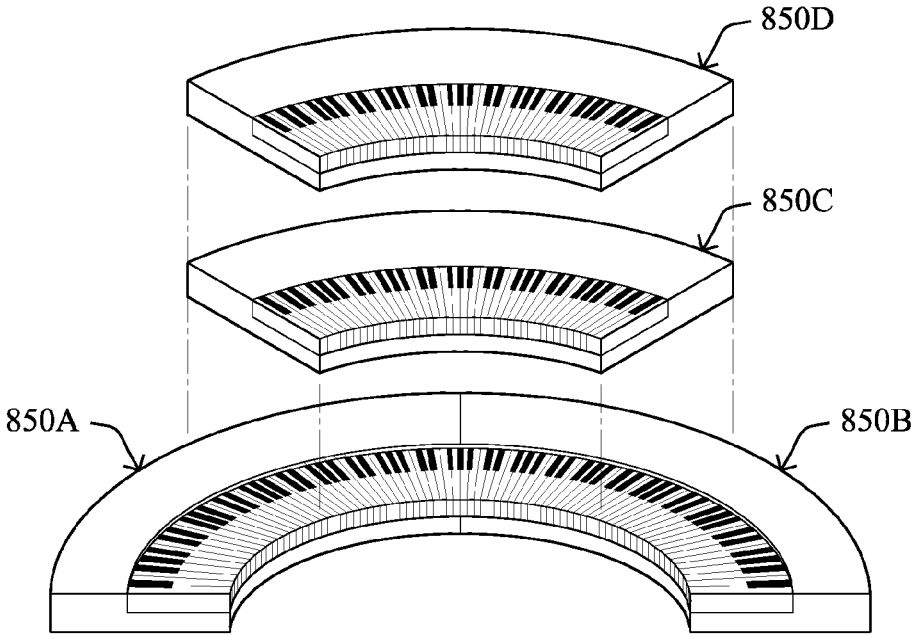

In certain embodiments, it may be permissible to separate the components 850 of the keyboard 100, while still allowing play of one or more of the separated components. For instance, FIG. 8C illustrates an example where only a portion (e.g., half) of the components 850 are used, such as to make a single semi-circular keyboard, which may be particularly useful where space is limited, such as on smaller stages or in smaller rooms. As a still further alternative, in FIG. 8D, the components 850 may be stacked, e.g., each separate component on top of each other, two halves of the keyboard (e.g., two semi-circles) on top of each other, or, as shown, one half of the keyboard with the other two quarter components (in a four-piece system) stacked individually on top of each other. Those skilled in the art will appreciate that other stacking configurations would be present when the number of components 850 that make up the keyboard 100 are used.

Figure 9:
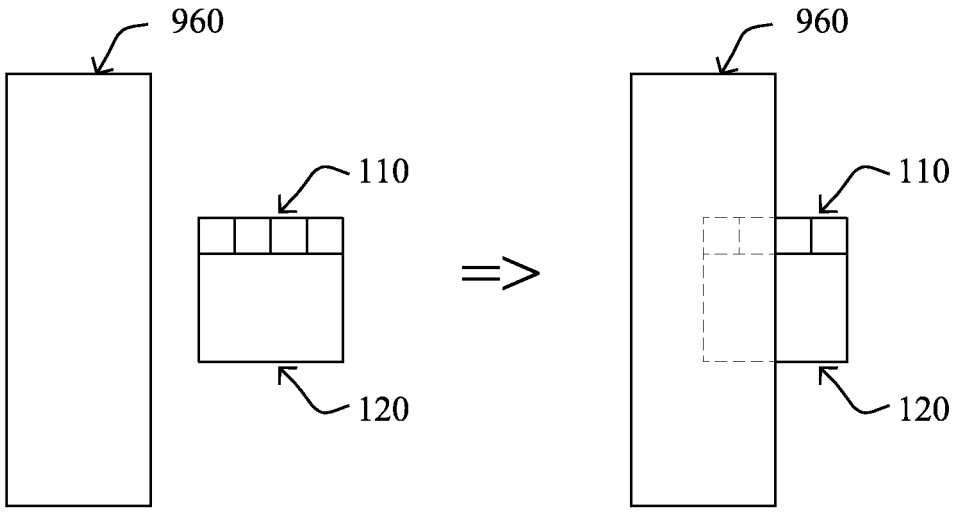
FIG. 9 illustrates an example end cap for transportation of a separable component of an illustrative circular piano keyboard.

In further regard to travel considerations, FIG. 9 illustrates an example end cap 960 for transportation of a separable component 850 of an illustrative circular piano keyboard 100. In particular, since in one embodiment, the keys 110 of the keyboard have no breaks between them, when the components 850 are separated, there is no protection for the end keys from being hit and possibly damaged. Accordingly, the removable end cap 960 may be placed over the end of the keyboard component as shown. Alternatively, in order to maintain the "break-less" look of the illustrative circular piano keyboard 100, a thin "end" may be used, such as one that does not interfere with the generally continual spacing of the keys as noted above. Note that still another embodiment may simply provide an "end" to each keyboard component 850, such as a conventional keyboard, and the circular piano keyboard 100 may thus merely be an interconnect of a plurality of curved keyboards with respective ends. In this manner, however, the keys 110 would have breaks between them where the physical components interconnected.

Additional features and/or embodiments of the circular piano keyboard 100 may be based on the placement of conventional digital piano functionality, such as pedals (e.g., the traditional soft pedal (una corda), sostenuto pedal or practice pedal, and sustain pedal), volume control (e.g., another pedal or knob/slider), etc. For example, many conventional digital pianos, keyboards, synthesizers, controllers, etc., have one or more control actuators, such as sliders, knobs, wheels, etc., such as for "pitch bend" (portamento), "mod wheel," a combined pitch/mod control, sound tweaking through knobs, buttons, etc., as may be appreciated by those skilled in the art. However, since these control actuators are often located at the end of the keyboard, when the keyboard is a continuous circle of keys, this location may no longer be practical or available.

Figure 10A:
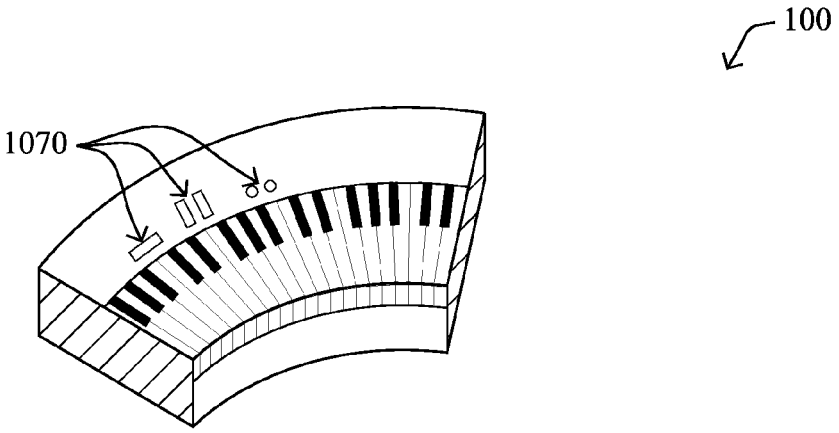
FIGS. 10A-10C illustrate example placements of control actuators for an illustrative circular piano keyboard.
Figure 10B:
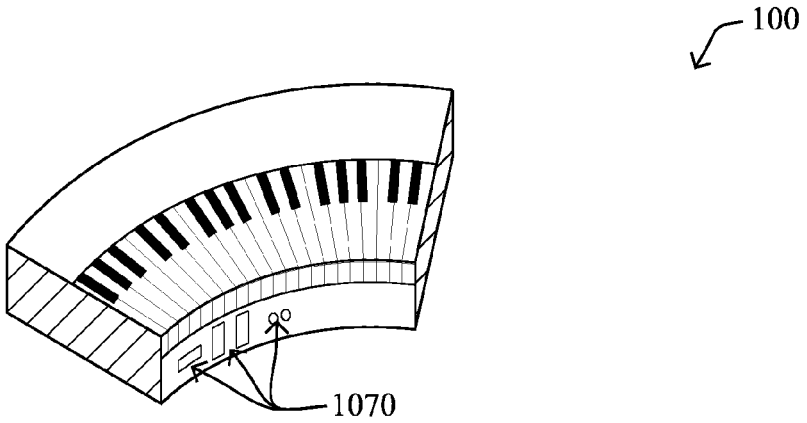
Figure 10C:
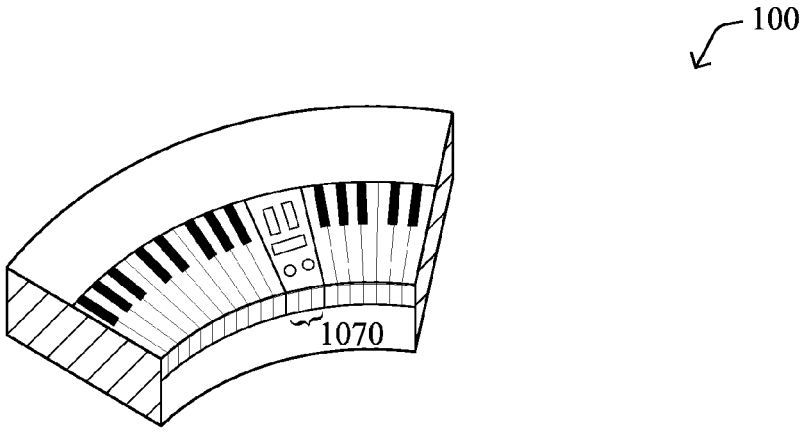

Illustratively, therefore, FIGS. 10A-10C show example placements of control actuators for an illustrative circular piano keyboard in accordance with one or more embodiments herein. For instance, in FIG. 10A, the control actuators 1070 are placed above the keys 110 on the housing 120. Alternatively, as in FIG. 10B, the control actuators 1070 may be placed under the keys 110. Note that in either FIG. 10A or 10B, the lateral location of the control actuators 1070 may be based on a general partition between keyboard divisions 450, or else at any other convenient location for skillful play. As a third alternative, such as where breaks between keyboard divisions are acceptable, then the control actuators 1070 may be placed within the keys 110 (i.e., within the "ring" of keys), such as at the end of keyboard divisions 450 or separable components 850.

Figure 11:
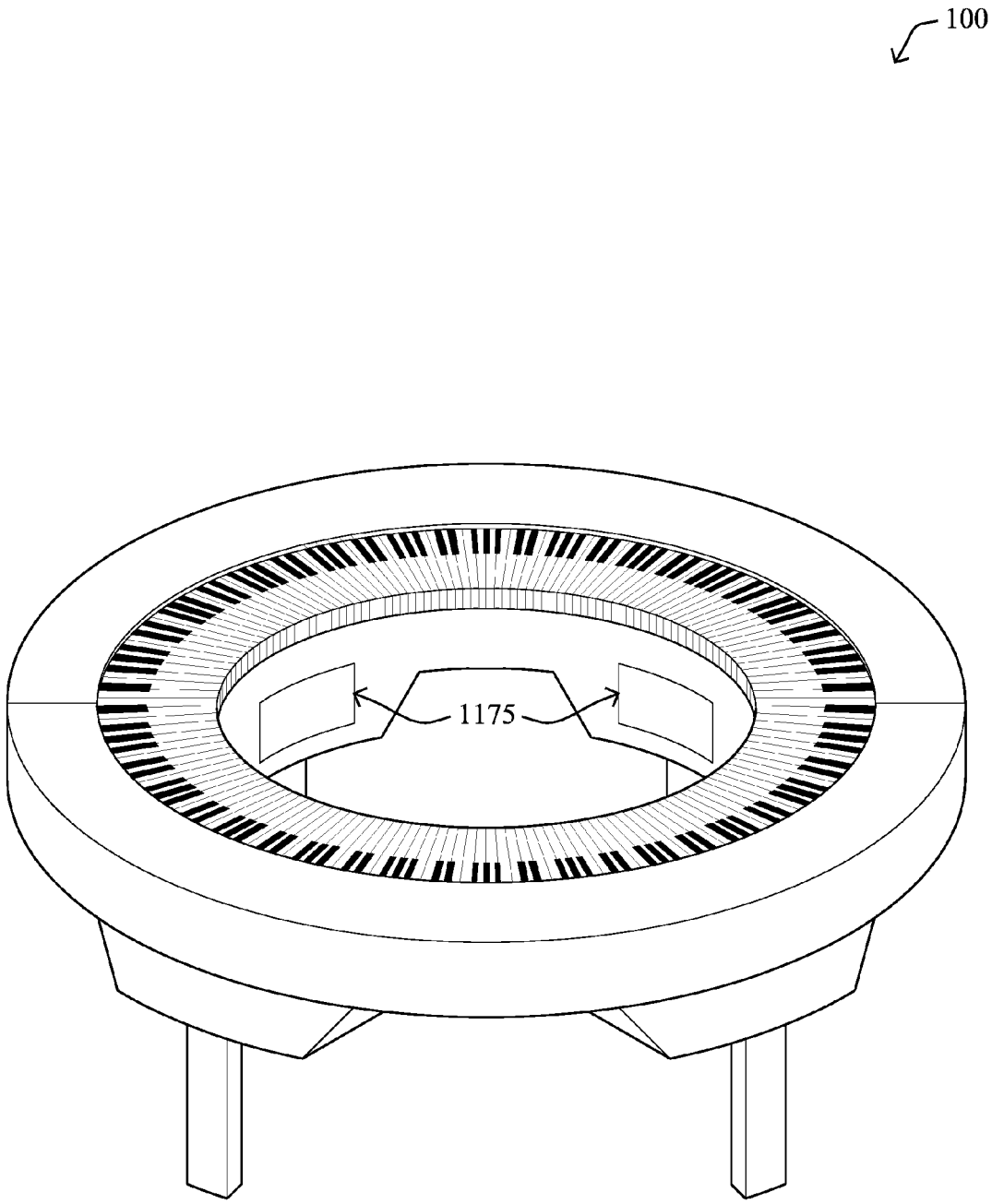
FIG. 11 illustrates an example placement of a user controller interface for an illustrative circular piano keyboard.

Furthermore, since many digital pianos communicate with software, particularly controllers or other stage pianos, FIG. 11 illustrates an example placement of a user controller interface 1175 for an illustrative circular piano keyboard 100. For example, many keyboards may interface with a computer, particularly where the keyboard is merely a controller, and the computer may create or modify sounds to send to speakers based on triggering from the keys 110 (and control actuators 1070) of the keyboard 100. As such, one or more controller interfaces 1175, such as a computer, laptop, touch-screen tablet, etc., may be connected to the keyboard 100. While a single controller interface 1175 may be used for the entire keyboard 100, multiple interfaces may be used to control the keyboard divisions 450 independently, or else to otherwise offer different readily available control (e.g., different functions/control established on different interfaces 1175). In addition, the controller interfaces 1175 may be used to program the functionality of the keyboard (e.g., as a controller or else the control actuators 1070), and/or the actual partitioning of the keyboard divisions 450 as noted above.

In general, the connection between a controller (keyboard 100) and the controller interface 1175 (e.g., and between electrical connections 856) is based on MIDI communication (the Musical Instrument Digital Interface), which is an industry-standard protocol that enables electronic musical instruments (synthesizers, drum machines), computers, and other electronic equipment (MIDI controllers, sound cards, samplers) to communicate and synchronize with each other. MIDI's primary functions include communicating event messages about musical notation, pitch, velocity, control signals for parameters (such as volume, vibrato, panning, cues, and clock signals (to set the tempo)) between two devices in order to complete a signal chain and produce audible sound from a sound source. MIDI controllers, for example, need to be connected to a voice bank or sound module in order to produce musical tones or sounds; i.e., the keyboard 100 is "controlling" the voice bank or sound module by acting as a trigger. Controller interfaces 1175 thus provide such control functionality, and may contain (or otherwise direct triggers toward) the sounds desired by the player.

Note that while most controllers do not produce sounds, some controller keyboards, called "performance controllers," may have MIDI-assignable keys, sliders, and knobs, which allow the controller to be used with a range of software synthesizers or voice modules, yet at the same time, the controller also has an internal voice module which supplies keyboard instrument sounds (piano, electric piano, etc.), sampled or synthesized voices (strings, woodwinds), and Digital Signal Processing (distortion, compression, flanging, etc.). These controller keyboards are designed to allow the performer to choose between the internal voices or external modules. Accordingly, in certain embodiments, this configuration may be embodied based on keyboard divisions 450, such that certain keyboard divisions are controllers, while others are set up with internal sounds/voices, etc.

Figure 12A:
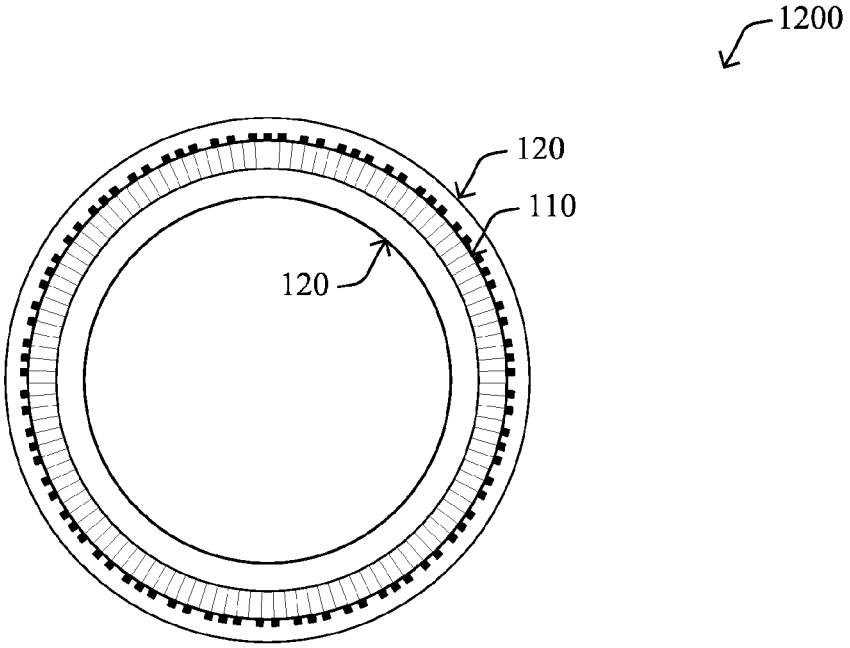
FIGS. 12A-12B illustrate an alternative embodiment for key orientation of an illustrative circular piano keyboard.
Figure 12B:
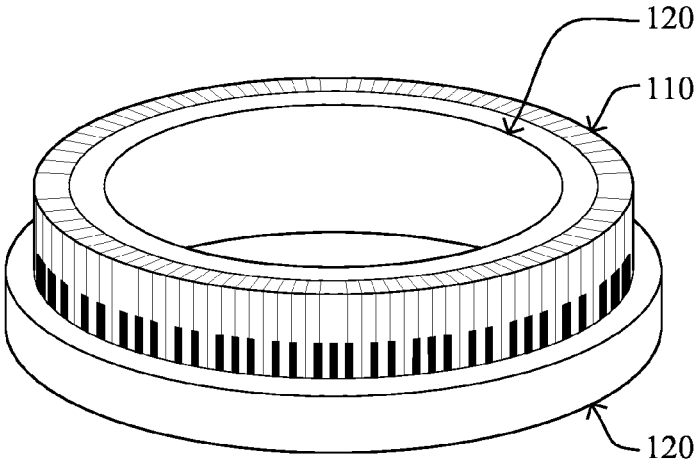

According to one or more embodiments herein, other illustrative embodiments of circular or otherwise rounded piano keyboards are also hereinafter described. For instance, while the keys 110 of the illustrative keyboard 100 above were generally planar, as shown in FIGS. 12A-12B, an alternative embodiment for key orientation of an illustrative circular piano keyboard 1200 has the keys 110 facing away from center of the piano keyboard, such that the player must reach over the top of the keyboard (now the ends of the keys 110) to play. In this embodiment, the keys are parallel to one another, but now curved inward along their bottom (opposite the finger-played side) to encircle the player. By facing the keys outward like this, whether at a fully vertical 90-degree orientation or else tilted outward by less than 90 degrees, an audience can readily see the keyboardists fingers skillfully playing the keys. Notably, since the arm orientation may be slightly changed to account for a bent wrist, the inner diameter of the keyboard 1200 may be slightly less than that of keyboard 100 above.

Figure 13A:
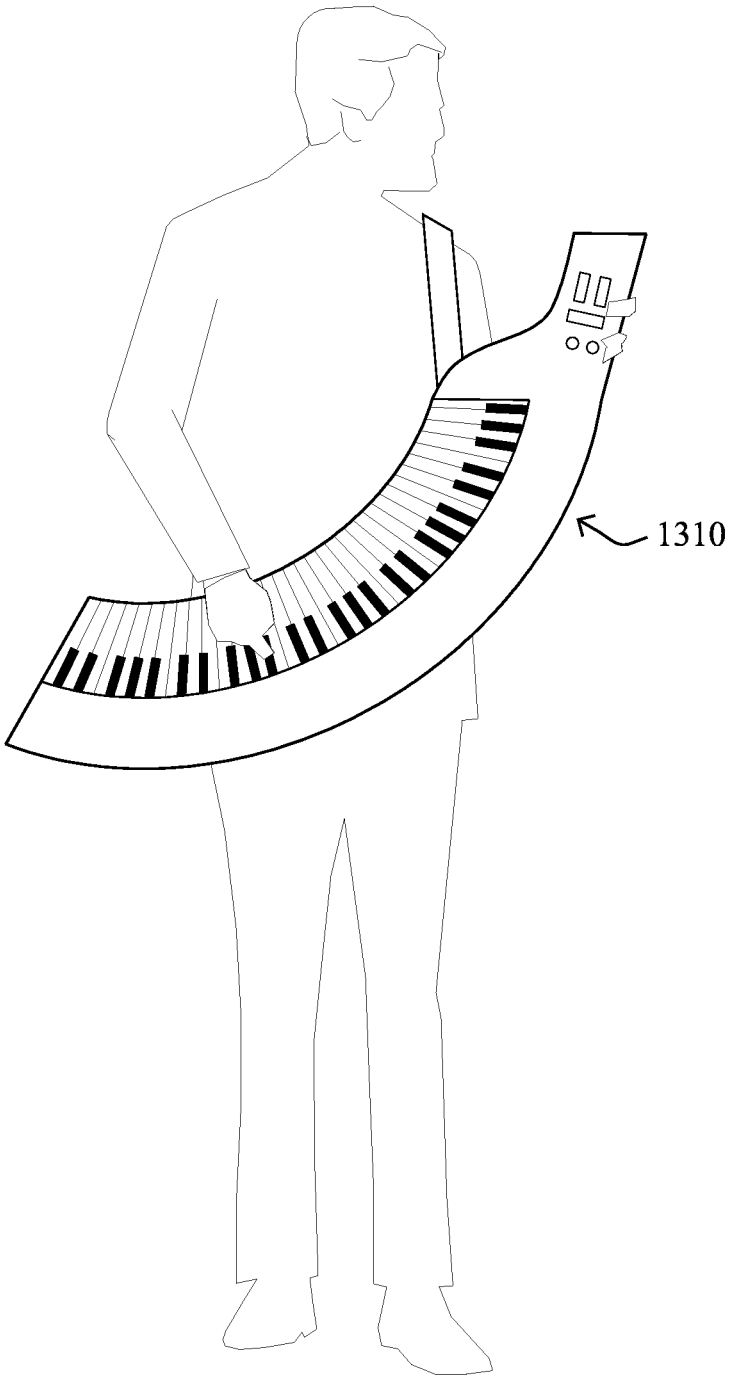
FIGS. 13A-13C illustrate alternative embodiments for wearable circular piano keyboards.

In addition, various wearable versions of the circular piano keyboard are disclosed herein, such as a curved "keytar" 1310 in FIG. 13A. A keytar is generally understood to be a set of piano keys worn with a shoulder strap like a guitar (keyboard/guitar=keytar). Similar to the design aspects set forth above for keyboard 100, key sizing, action, etc., may be taken into consideration in the design of the curved keytar 1310, accordingly.

Figure 13B:
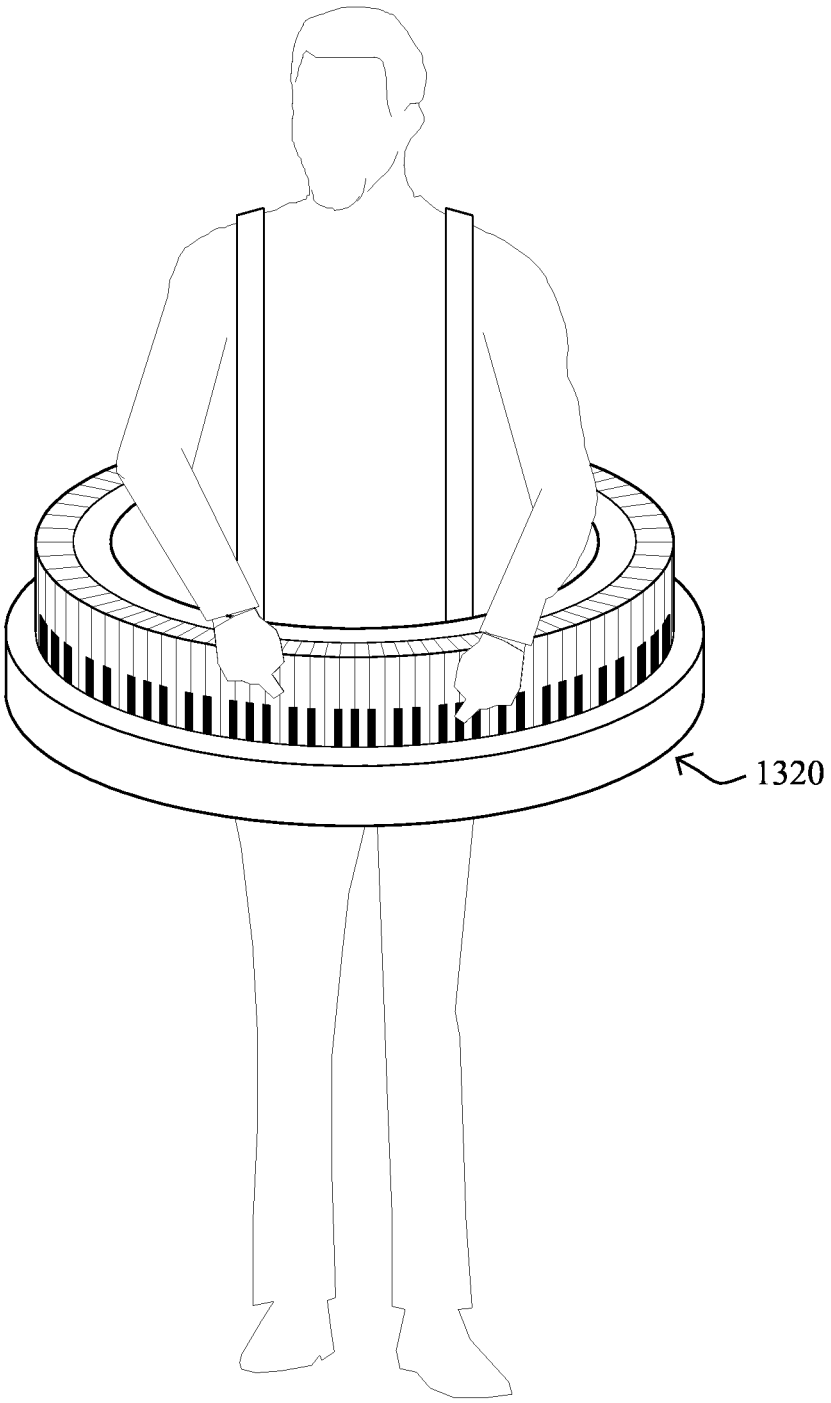

As another embodiment, the outward-facing keyboard 1200 of FIGS. 12A-12B may be sized accordingly to also be worn as the keyboard 1320 shown in FIG. 13B. Note that the keyboard 1320 need not be fully encircling (as it may be difficult to play keys facing away from the player's back), but may be, whether fully functional (all keys can be played), or simply for decoration.

Figure 13C:
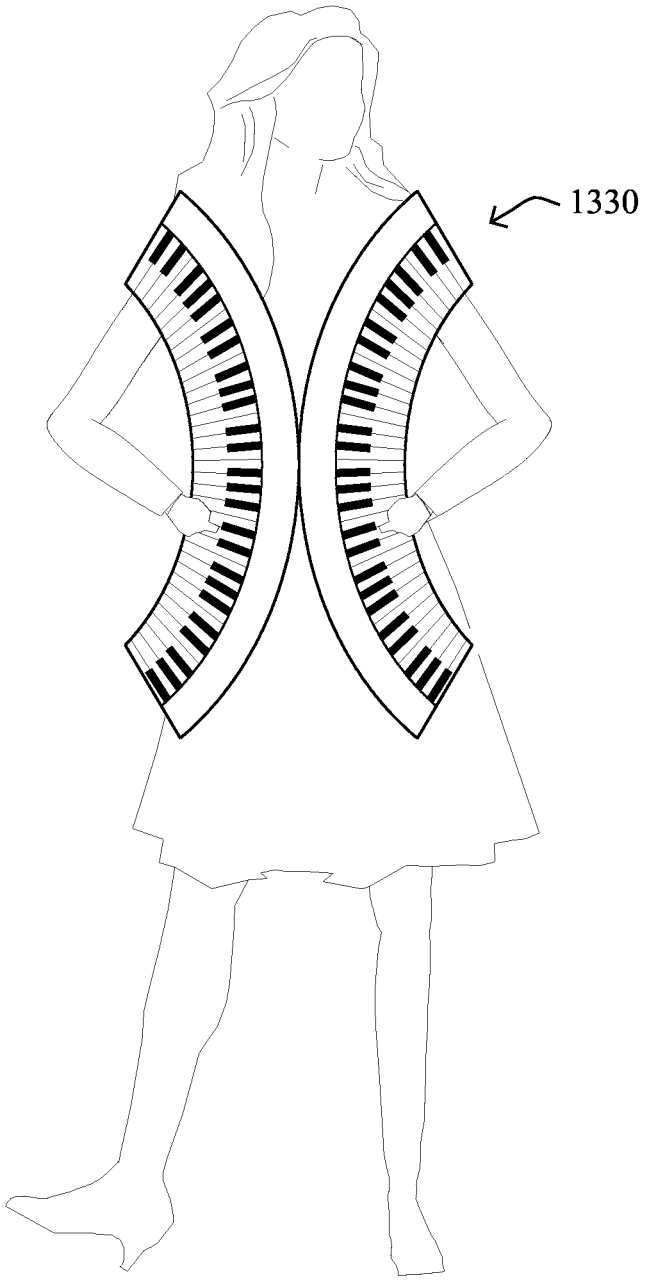

In still another wearable embodiment as shown in FIG. 13C, two opposing curved keyboard divisions/components may be worn as a curvaceous piano dress (or "keydress," as defined herein) 1330 as shown, such that the player/wearer (or other players) may play the keys on the front of the wearer's body.

Figure 14A:
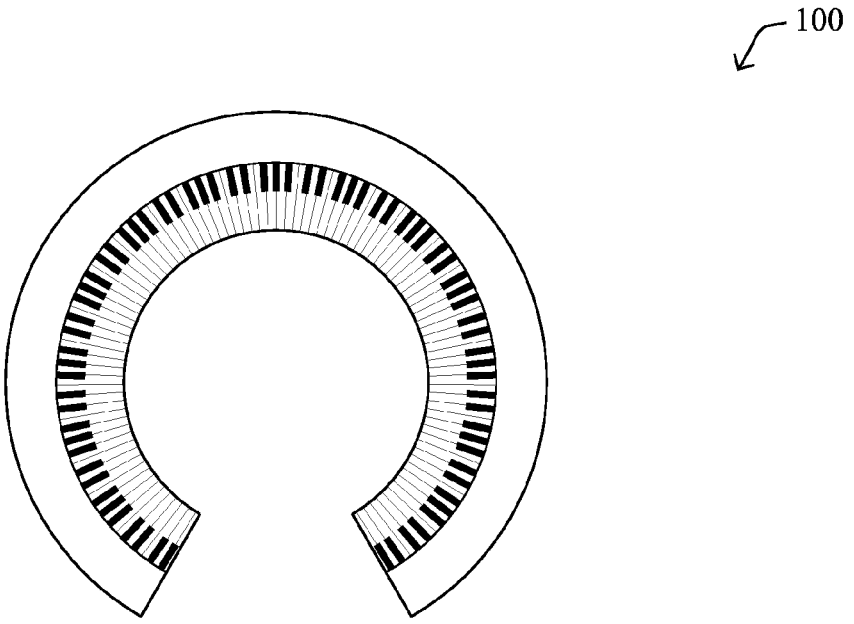
FIGS. 14A-14B illustrate an example of reach-resizing for an illustrative circular piano keyboard.
Figure 14B:
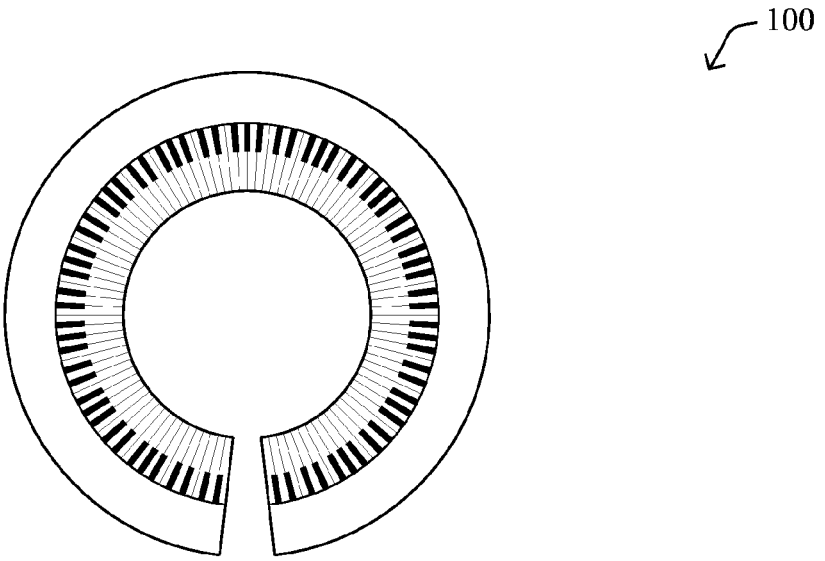

Lastly, FIGS. 14A-14B illustrate an example of reach-resizing for an illustrative circular piano keyboard 100. In particular, through redesign, it may be possible to expand or contract the overall size of the keyboard 100 in order to adjust the playing diameter/radius of the keyboard, e.g., for different sized players and levels of comfort. Generally, the design aspects set forth above for keyboard 100, key sizing (at location 310A), action, etc., may be maintained in the embodiment of FIGS. 14A (expanded) and 14B (contracted), such that the key sizing at location 310A is maintained, and only the spacing between the keys at locations 310B and 310C are altered in any way. That is, the key angle is rotated about location 310A when expanding or contracting the keyboard 100. In this instance, since generally the keyboard 100 may encompass a plurality of non-fully-encircling 88-key sections, an opening established by the remaining space (such as opening 605 in FIG. 6A) may be filled with an appropriately selected number of additional keys, such as for function control as described above. In another embodiment, a spreader mechanism, such as a turn crank and associated gearing/threading, may be used to expand and contract the keyboard to accommodate the changes in diameter, where the housing 120 is flexible or has one or more adequately placed hinges.

Advantageously, according to one or more of the illustrative embodiments above, the novel circular piano keyboard details described herein provide not only for aesthetic enhancement, and in certain instances space-saving practicality, but they also achieve practicality of the product, such as for a stage performance. That is, said differently, in addition to the novel concept of a circular piano keyboard, the invention herein may also comprise one or more of the specific features described herein to allow for the useful functionality of such a design.

While there have been shown and described illustrative embodiments of a circular piano keyboard, it is to be understood that various other adaptations and modifications may be made within the spirit and scope of the embodiments herein. For example, the embodiments have been shown and described herein with reference to a "piano keyboard." However, the embodiments in their broader sense are not as limited, and may, in fact, be used with other types of piano-like keyboard instruments, such as, e.g., a digital piano, stage piano, keyboard, synthesizer, controller, etc., as mentioned above. In addition, while the term "circular" is used, it is to be expressly noted that any non-linear, generally curved shape and/or orientation of the keys are included in the definition of a "circular keyboard" herein. Therefore, the terms "circular" or other similar terms herein are not meant to imply a precise radius, a constant curvature, or any specifically regular shapes or orientations, nor are they meant to imply a fully encircling design.

In addition, it is expressly contemplated that certain components and/or elements described herein can be implemented as software being stored on a tangible (non-transitory) computer-readable medium (e.g., disks/CDs/etc.) having program instructions executing on a computer, hardware, firmware, or a combination thereof. For example, various controller functionality based on the circular piano keyboards features, such as division of the key control, lighting of the keys, etc., may be executed by computer software (e.g., executing on the controller interfaces 1175 or otherwise). In addition, various methods of making or assembling the components described above, or for using any of the illustrative embodiments above, are expressly considered herein.

Accordingly, the foregoing description has been directed to specific embodiments. It will be apparent, however, that other variations and modifications may be made to the described embodiments, with the attainment of some or all of their advantages. This description is thus to be taken only by way of example and not to otherwise limit the scope of the embodiments herein. Therefore, it is the object of the appended claims to cover all such variations and modifications as come within the true spirit and scope of the embodiments herein.

What is claimed is:

1. A curved digital piano keyboard, comprising:

a plurality of natural and accidental piano keys, the piano keys being in a single plane and collectively forming an inward-facing arc toward a central reference point, wherein a size of the piano keys conforms generally to a conventional dimension of natural and accidental piano keys at least at a play location of the respective keys;

a key action mechanism configured to return each piano key to an original position after being depressed and subsequently released; and electronic sensor circuitry configured to generate sensor signals when one or more piano keys are being depressed, the sensor circuitry having a radius which falls within a range of a radius of a front of accidental keys and a common radius of the accidental keys, wherein each piano key has a top, bottom, front, and back, and wherein the key action mechanism comprises:

a lever having a front and back;

one or more fasteners attaching the front of the lever to the top and back of a respective piano key;

one or more springs having a top and bottom, the top of the one or more springs attached to the back of the lever and the bottom of the one or more springs are attached to an underlying structure beneath the bottom of the piano key, wherein the one or more springs are configured with tension to return the piano key to an original position after being depressed and subsequently released; and a pivot point for the lever, the pivot point contacting the top of the respective piano key, wherein the one or more fasteners comprise a first and second screw on opposing sides of the pivot point, and wherein adjusting the first and second screws adjusts the tension of the one or more springs.

2. The curved digital piano keyboard as in claim 1, wherein the plurality of piano keys define a full circle.

3. The curved digital piano keyboard as in claim 1, wherein a radius of the inward-facing arc is from a 24-inch to 28-inch radius.

4. The curved digital piano keyboard as in claim 1, further comprising:

a plurality of additional natural and accidental piano keys that collectively form a straight line.

5. The curved digital piano keyboard as in claim 1, wherein a total number of the piano keys exceeds 88.

6. The curved digital piano keyboard as in claim 1, further comprising:

a plurality of keyboard divisions composed of a respective portion of the plurality of piano keys, each keyboard division defining a respective controller configuration.

7. The curved digital piano keyboard as in claim 6, wherein a first keyboard division is configured to control a first set of sounds and a second keyboard division is configured to control a second set of sounds different from the first set of sounds.

8. The curved digital piano keyboard as in claim 6, further comprising:

visual indications that differentiate between the plurality of keyboard divisions.

9. The curved digital piano keyboard as in claim 1, further comprising:

a tilting stand to support the digital piano keyboard.

10. The curved digital piano keyboard as in claim 1, wherein at least the plurality of natural piano keys are tapered away from the central reference point.

11. The curved digital piano keyboard as in claim 1, further comprising:

a plurality of physically separable keyboard components composed of a respective portion of the plurality of piano keys.

12. The curved digital piano keyboard as in claim 1, wherein the play location for both the natural piano keys and accidental piano keys is located generally at an end of the accidental piano keys facing the central reference point.

13. The curved digital piano keyboard as in claim 1, wherein the keyboard is wearable by a player.

14. The apparatus as in claim 1, wherein the pivot point is a separate component from the lever.

15. An apparatus, comprising:

a piano key having a top, bottom, front, and back;

a lever having a front and back;

one or more fasteners attaching the front of the lever to the top and back of the piano key;

one or more springs having a top and bottom, the top of the one or more springs attached to the back of the lever;

an underlying structure beneath the bottom of the piano key;

wherein the bottom of the one or more springs are attached to the underlying structure, and wherein the one or more springs are configured with tension to return the piano key to an original position after being depressed and subsequently released; and a pivot point for the lever, the pivot point contacting the top of the piano key;

wherein the one or more fasteners comprise a first and second screw on opposing sides of the pivot point, and wherein adjusting the first and second screws adjusts the tension of the one or more springs.

16. The apparatus as in claim 15, wherein the pivot point is a separate component from the lever.

17. The apparatus as in claim 15, wherein the apparatus is located within a curved digital piano keyboard, comprising:

a plurality of natural and accidental piano keys, the piano keys being in a single plane and collectively forming an inward-facing arc toward a central reference point, wherein a size of the piano keys conforms generally to a conventional dimension of natural and accidental piano keys at least at a play location of the respective keys; and electronic sensor circuitry configured to generate sensor signals when one or more piano keys are being depressed, the sensor circuitry having a radius which falls within a range of a radius of a front of accidental keys and a common radius of the accidental keys.

* * * * *